US010495399B1

(12) United States Patent
Dalessio et al.

(10) Patent No.: US 10,495,399 B1
(45) Date of Patent: Dec. 3, 2019

(54) NON-DETACHABLE, RELOADABLE BOX MAGAZINE SYSTEM

(71) Applicants: Robert Dalessio, Bakersfield, CA (US); Brian McDaniel, Caliente, CA (US); Ian McDaniel, Caliente, CA (US)

(72) Inventors: Robert Dalessio, Bakersfield, CA (US); Brian McDaniel, Caliente, CA (US); Ian McDaniel, Caliente, CA (US)

( * ) Notice: Subject to any disclaimer, the term of this patent is extended or adjusted under 35 U.S.C. 154(b) by 0 days.

(21) Appl. No.: 15/907,188

(22) Filed: Feb. 27, 2018

Related U.S. Application Data

(60) Provisional application No. 62/464,293, filed on Feb. 27, 2017.

(51) Int. Cl.

| | |
|---|---|
| ***F41A 17/38*** | (2006.01) |
| ***F41A 3/66*** | (2006.01) |
| ***F41A 9/71*** | (2006.01) |
| ***F41A 9/84*** | (2006.01) |
| ***F41A 9/66*** | (2006.01) |

(52) U.S. Cl.
CPC ..... *F41A 17/38* (2013.01); *F41A 3/66* (2013.01); *F41A 9/66* (2013.01); *F41A 9/71* (2013.01); *F41A 9/84* (2013.01)

(58) Field of Classification Search
CPC ..... F41A 9/01; F41A 9/24; F41A 9/25; F41A 9/61; F41A 9/64; F41A 9/65; F41A 9/66; F41A 9/71; F41A 17/38; F41A 3/66
USPC ..... 42/6, 87
See application file for complete search history.

(56) References Cited

U.S. PATENT DOCUMENTS

| | | | | |
|---|---|---|---|---|
| 1,379,075 | A * | 5/1921 | Ashworth | F41A 9/84 42/88 |
| 5,309,660 | A * | 5/1994 | Blackamore | F42B 33/14 42/106 |
| 8,407,922 | B1 * | 4/2013 | Taylor | F41A 9/66 42/49.01 |
| 2007/0157501 | A1 * | 7/2007 | Cammenga | F41A 9/67 42/87 |
| 2010/0126053 | A1 * | 5/2010 | Fitzpatrick | F41A 9/69 42/50 |
| 2013/0192115 | A1 * | 8/2013 | Calilung | F41A 9/71 42/49.01 |
| 2016/0025436 | A1 * | 1/2016 | Higley | F41A 9/65 42/49.01 |
| 2017/0227312 | A1 * | 8/2017 | Christensen | F41A 3/66 |

FOREIGN PATENT DOCUMENTS

| | | | | |
|---|---|---|---|---|
| EP | 205661 | A2 * | 12/1986 | |
| GB | 482212 | A * | 3/1938 | F41A 9/66 |

OTHER PUBLICATIONS

"FC Hook: Fully Compliant" (https://torqueprecision.com/p/aboutfchook). PDF submitted herewith retrieved May 24, 2018.

* cited by examiner

*Primary Examiner* — Bret Hayes
(74) *Attorney, Agent, or Firm* — R. Scott Kimsey, Esq.; Klein DeNatale Goldner

(57) ABSTRACT

An improved rifle includes a magazine body attached to the rifle, and a base plate releasably and slidingly engaging the magazine body and forming a base of the magazine body. A release is provided to unlock the base plate when actuated by a user of the rifle. The base plate is configured to move away from the magazine body when unlocked, thereby exposing an inner chamber of the magazine body for insertion of an ammunition stripper clip thereinto.

5 Claims, 28 Drawing Sheets

90
92
94
96
98
100
102
104
106
108
110
112
114

248
249
247
262
260
258
252
256
240
242
243
244
248
234
235
228
236

215
230
232
224
225
226
218
222
214
234
228
236
210

215
232
230
254
252
212
216
219
210
220
234
228
236

290
292
294
296
298
300
302
304
306
308
310
312
314

432
454
430
422
418
478
476
416
419
420
474
470
482
449
480
442
443
414
464
428
446
436
437
439

432
454
430
476
478
424
480
482
484
472
470
414
464
416
419
430
486

455
462
460
450
453
452
456

455
462
450
457
453
452
456

476
478
420
470
414
422
482
526
516
520
418
452
458
440
448
35
428
436
456
522
518
524

490
492
494
496
498
500
502
504
506
508
510
512
514
516

668
664
665
629
677
633
673

681
631
647
679
610

681
659
647
681

634
657
644
685
689
634
670
635

641
645

NON-DETACHABLE, RELOADABLE BOX MAGAZINE SYSTEM

RELATED APPLICATIONS

This application claims priority to U.S. Provisional Patent Application No. 62/464,293, filed Feb. 27, 2017 and entitled "Non-Detachable, Reloadable Box Magazine System."

BACKGROUND AND FIELD

1. Field

The present device relates to an original reloadable, non-detachable box magazine for carbine type rifles that are similar to commercially available detachable magazines yet sufficiently improved in that it is non-removable while being reloadable, preferably with no more than ten rounds of ammunition preloaded on a commercially available stripper clip.

2. Background

In the past magazines for carbine type rifles were detachable from the rifle receiver by pressing a button or using a tool to depress an interior magazine release catch, such that the magazine would drop away from the rifle's receiver or could be physically removed. Such systems are well known in the art. Legislation in some U.S. states prohibits the use of detachable magazines with some weapon types. The detachable magazines prohibited in California, for example, include any ammunition feeding device that can be removed readily from a firearm with neither disassembly of the firearm action or use of a tool.

Attempts have been made to provide locking mechanisms to prevent detachment of a magazine. Such "magazine locks" suffer from disadvantages, however. For example, magazine locks with an upwardly-oriented locking pin may require a tool to depress the pin, allowing insertion of the magazine into the rifle. Further, such an upward orientation may interfere with the functioning of the follower. Because the index slot for the magazine lock in a conventional metal AR-15, for example, is flat in comparison to the body of the magazine, the magazine lock my be forced to extend further into the magazine to engage the locking pin, which may wear on the inside of the receiver. Finally, existing locking mechanisms may require opening of a weapon's action for reloading, which may wear out pins and pinholes between the receiver and the rest of the weapon.

SUMMARY

The present device provides a non-detachable box magazine for carbine type rifles to comply with state laws that ban detachable magazines. One embodiment of the present device provides a reloadable, non-detachable system for use in current commercially available carbine rifles using a preloaded, ten-round, commercially available stripper clip of ammunition.

Once the present magazine is inserted into a carbine rifle it cannot be removed without the opening the rifle's 'action' and using a tool to pull up on a securing detent located at the bottom of the magazine locking device, allowing the user to press the magazine release button located on the side of the receiver of the carbine rifle and removing the magazine. This is a cumbersome process designed to prevent rapid removal of the device and comply with state law.

In one broad aspect, the present device may be considered a non-detachable, reloadable box magazine system having a magazine body of two sides, opposing end walls, an open top with curved feed lips, an open bottom with base plate stop tabs, base plate arched receiver pocket, stripper clip stop tabs, squeeze tab receiver lock detents, magazine and upper magazine index slot and stop tab.

The system is further comprised of a non-removable but detachable base plate, rear magazine wall cover, base plate stop tabs, squeeze tab release, base plate arched receiver guide, capacity limiting block, spring, base spring retention tab, follower, follower guide tabs, follower spring retention tab, follower leveling guides, and follower spring torque limiter.

Additional system components include a magazine locking device with threaded rod, span arm, magazine retention tab, and locking detent.

The various embodiments described herein operate generally as follows, with greater detail regarding the operation provided below. When a user squeezes the squeeze tabs located on each side of the base plate, the base plate locking tab disengages from the opposing squeeze tab receiver lock detent. This allows the user to pull the base plate in a downward motion. The base plate arched guide attached to the base plate is indexed by the magazine body base plate arched receiver pocket, which keeps the base assembly aligned in the proper curved orientation. This process pulls the spring, follower, capacity limiting block, base plate arched guide, and magazine rear wall cover downward while keeping all components aligned to the curve of the magazine body and exposing the inner chamber of the magazine. The capacity limiting block in conjunction with the base plate arched guide and the follower guide tabs act to keep the spring and follower oriented in the same arched manner until the base of the follower and base plate arched guide contact the base plate stops located on the inside of the magazine body walls and the top of the base plate arched guide.

This process reveals the inner chamber of the magazine body. At this point the user inserts one preloaded ten-round ammunition stripper clip into the open magazine inner chamber until it meets the stripper clip stop tabs located inside the magazine body wall.

The user then reverses the process and closes the magazine base plate, follower, spring, base plate arched guide, capacity limiting block, and rear magazine wall cover until the base plate squeeze tabs re-engage the opposing magazine body lock detents, completing the process of closing the magazine. In this process, the follower makes contact with the bottom shell casing of ammunition held in place by the stripper clip, causing the follower and spring to compress until enough pressure is applied to cause the rounds to release through the top tab of the stripper clip where they are then pushed upward into the upper part of the magazine body. The rounds are held in index by the shell casing guide slot, shell casing guide tabs, follower guide/shell case nose guide rails, and the follower until they are forced up and against the feed lip located at the top of the open magazine body.

One aspect of the present disclosure provides an improvement to a rifle having a lower receiver defining a magazine chamber. The improvement includes a magazine body attached to the rifle, and a base plate releasably and slidingly engaging the magazine body and forming a base of the magazine body. A release is provided to unlock the base plate when actuated by a user of the rifle. The base plate is configured to move away from the magazine body when unlocked, thereby exposing an inner chamber of the magazine body for insertion of an ammunition stripper clip thereinto.

Another aspect of the present disclosure provides an improved rifle further having a locking member removably attached to the magazine body. The locking member includes a threaded rod configured for insertion through an opening defined in the lower receiver of the rifle and an arm extending from the threaded rod at about a ninety degree angle thereto. A detent member extends downwardly from the arm. The detent member is configured to be received into a slot defined in the magazine body, and when the detent member is received into the magazine body the magazine body is securely affixed to the rifle.

Another aspect of the present disclosure provides an improved rifle in which the threaded rod is configured to be inserted into an opening sized and shaped to receive a conventional magazine release assembly.

Another aspect of the present disclosure provides an improved rifle in which a tab extends from the base plate. The tab is configured to be received into a slot defined in the magazine body.

Another aspect of the present disclosure provides an improved rifle having an arched guide extending upwardly from the base plate and an arched receiver pocket defined in the magazine body and configured to slidingly receive the arched guide. A first stop tab extends from the arched receiver pocket. A second arched tab extends from the arched guide. When the base plate is moved slidingly in a downward direction, away from the magazine body, contact between the first stop tab and the second stop tab prevents the base plate from being detached from the magazine body.

Another aspect of the present disclosure provides an improved rifle having a rear wall cover plate extending upwardly from the base plate. The magazine body is configured to slidingly receive the rear wall cover plate. When the base plate is locked to the magazine body, the rear wall cover plate cover the inner chamber of the magazine body. When the base plate is disengaged from the magazine body, the downward movement of the base plate, and corresponding downward movement of the rear wall cover plate, exposes the inner chamber of the magazine.

Another aspect of the present disclosure provides an improved rifle having a lower receiver defining a magazine chamber. The improved rifle includes a magazine body attached to the rifle. A locking member is included, having a threaded rod configured to be received through the lower receiver of the rifle. The locking member also has an arm extending away from the threaded rod and a detent member extending away from the arm in other than an upward direction. A base plate is slidingly engaged with the magazine body and movable between a first position and a second position. When the base plate is in the second position, an opening is defined in the magazine body, thereby exposing an inner chamber of the magazine body. The opening is sized and shaped to receive an ammunition stripper clip. When the detent member is received into a slot defined in the magazine body, the magazine body cannot be removed from the rifle.

In another aspect of the present disclosure, when the detent member and slot are mated they are accessible only by opening the action of the rifle.

Another aspect of the present disclosure provides a box magazine having a magazine body including a slot defined therein. The slot is configured to receive a detent member from a locking member associated with the lower receiver of a rifle. A base plate is slidingly engaged with the magazine body and moveable between a first position and a second position. When the base plate is in the second position, and opening is defined in the magazine body, exposing an inner chamber of the magazine body. The opening is sized and shaped to receive an ammunition stripper clip.

In another aspect of the present disclosure, the slot defined in the box magazine is in such a position as to receive the detent member only if the detent member extends other than in an upward direction from the locking member.

In another aspect of the present disclosure, an upper end of the box magazine is configured to be received into a conventional magazine chamber of a lower receiver of a rifle.

In another aspect of the present disclosure, the box magazine includes an arched guide extending upwardly from the base plate and an arched receiver pocket defined in the magazine body and configured to slidingly receive the arched guide. A first stop tab extends from the arched receiver pocket. A second arched tab extends from the arched guide. When the base plate is moved slidingly in a downward direction, away from the magazine body, contact between the first stop tab and the second stop tab prevents the base plate from being detached from the magazine body.

Another aspect of the present disclosure provides a locking magazine catch assembly having a span arm, a threaded rod extending from the span arm, a biasing member attached to the span arm, and a detent member engaging the biasing member such that the biasing member reversibly biases the detent member away from the span arm in other than an upward direction. The biasing member may be a spring or any other suitable biasing member. The detent member is configured to be received into an opening defined by the magazine body.

In another aspect of the present disclosure, the threaded rod is configured for insertion through an opening defined in a lower receiver of a rifle.

DETAILED DESCRIPTION

Directional words such as upward, downward, upwardly, downwardly, top, bottom, front, rear, and the like may be used herein to describe the orientation of certain components of the present disclosure. It is to be understood that such words are provided for purposes of clarity and are not intended to limit the scope of the present disclosure unless clearly so indicated. Such directional words describe the orientation of one or more given components of the present disclosure during normal operational use of the device of the present disclosure (e.g. when the weapon associated therewith is held in its usual position for firing).

Figure 2:
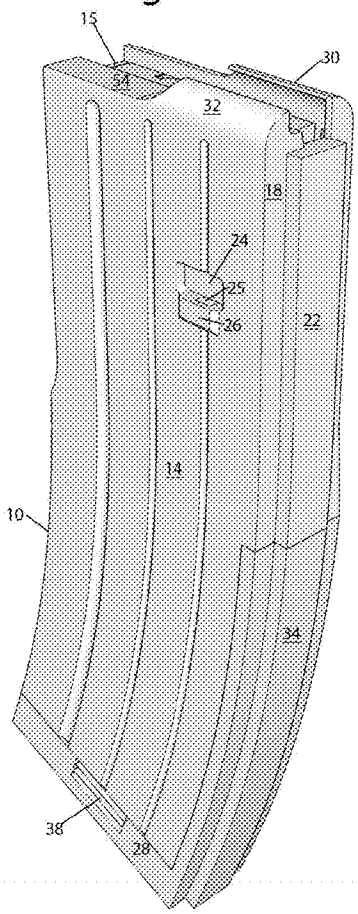
FIG. 2 is an opposing elevational side view of a non-detachable, reloadable box magazine device.
Figure 1:
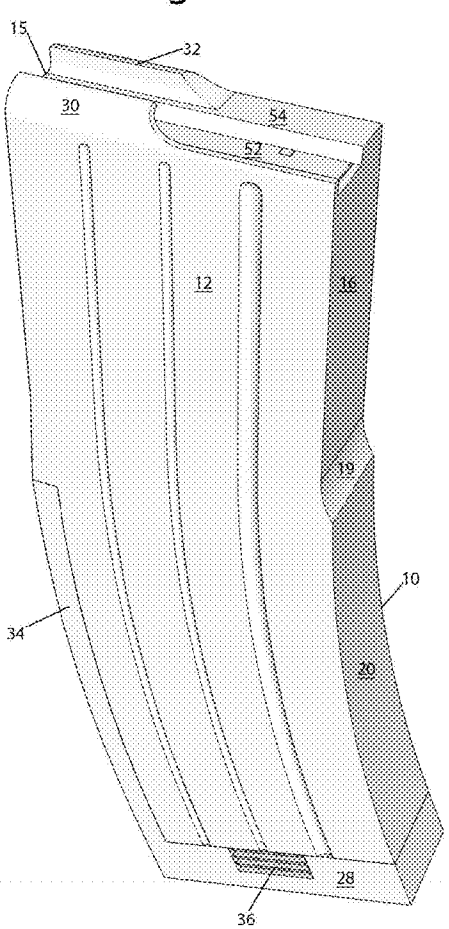
FIG. 1 is a side elevational view of a non-detachable, reloadable box magazine device.

FIG. 1 and FIG. 2 illustrate opposing views of the magazine system in the closed configuration as a box magazine body indicated generally as 10 in having side walls 12 and 14, mutually opposing end walls 16 and 18, open top 15 with curved feed lips 30 and 32, a base plate 28, with upper magazine index slot 24, stop tab 26, and magazine index tab 22. The shape of the box magazine 10 is that of an arched box. The end walls 16 and 18 are expanded in the lower arched section in by expansion arch 19 and lower expanded end wall 20, to allow clearance for the preloaded ten round ammunition stripper clip (shown in FIG. 17).

Figure 3:
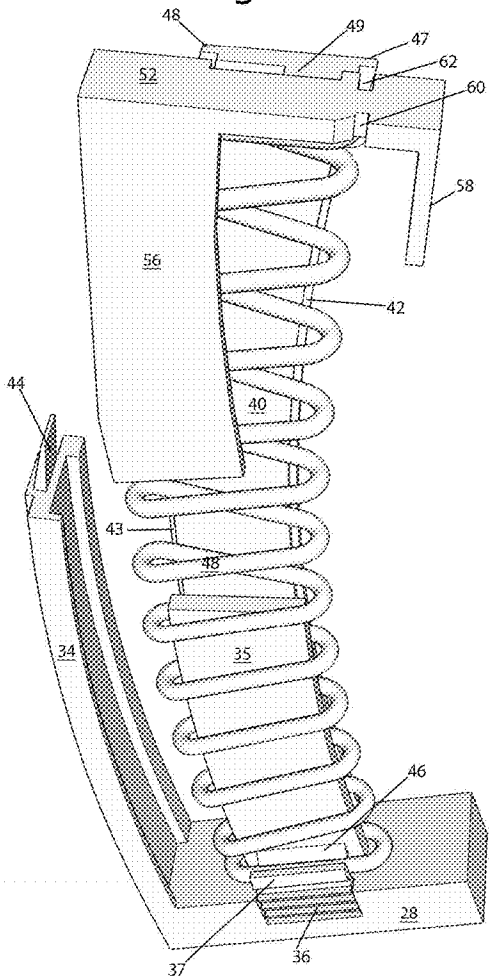
FIG. 3 is an elevational view of the internal components of the base assembly of a non-detachable, reloadable box magazine device.

FIG. 3 illustrates the internal components of the magazine system, including the base plate 28, squeeze tabs 36 and 38 (not shown), squeeze tab lock 37, spring retaining tab 46, rear magazine wall cover 34, rear wall cover catch tab 44, base plate arched guide 40, arched guide tabs 42 and 43, spring 48, follower, indicated generally as 52 (se FIGS. 7 and 8 for detail), follower spring tab 50 (shown in FIG. 8), follower end guides 58 and 59 (also shown in FIG. 8), spring torque limiter 56, tab receiver slots 60 and 62 and capacity limiting block 35.

Figure 4:
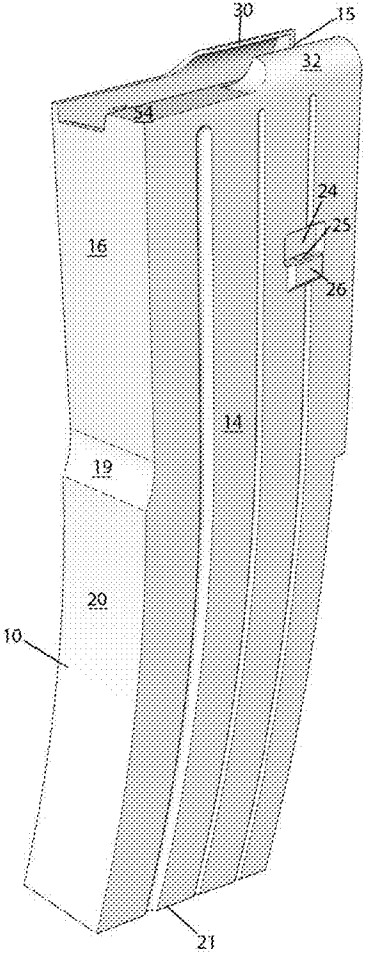
FIG. 4 is an elevational view of the magazine body of the device of FIG. 1, without the internal components of FIG. 3.

FIG. 4 illustrates the magazine body 10 absent the internal system components of FIG. 3.

Figure 5:
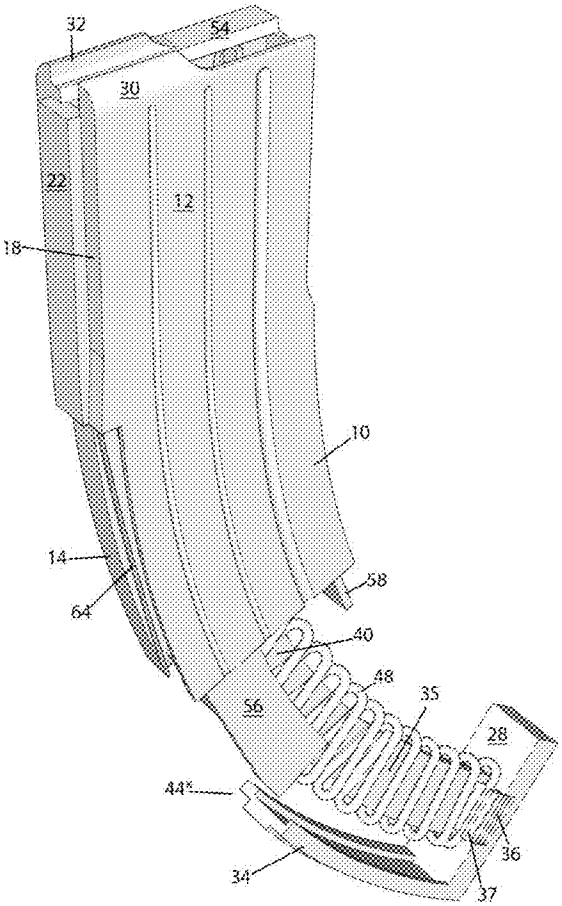
FIG. 5 is an elevational view of a non-detachable, reloadable magazine system in its fully open position.

FIG. 5 illustrates various system components (described in FIGS. 1, 2 and 3) together in an open configuration.

Figure 6:
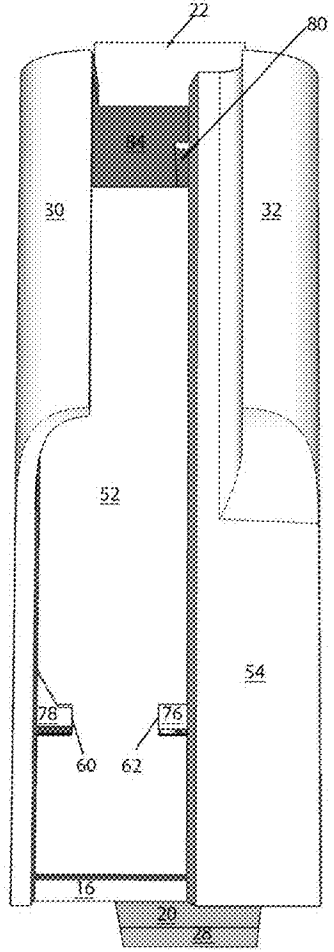
FIG. 6 is a top view of the magazine body of the device of FIG. 1 showing the follower in its top most position.
Figure 10:
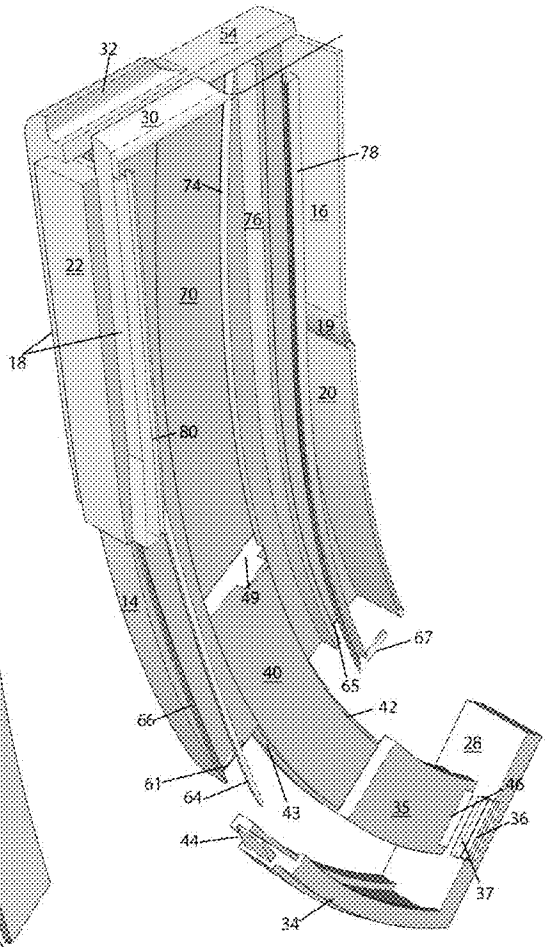
FIG. 10 is an elevational cutaway view of the internal components of a box magazine of the present disclosure showing the function of the base plate assembly in relation to the box magazine body.
Figure 9:
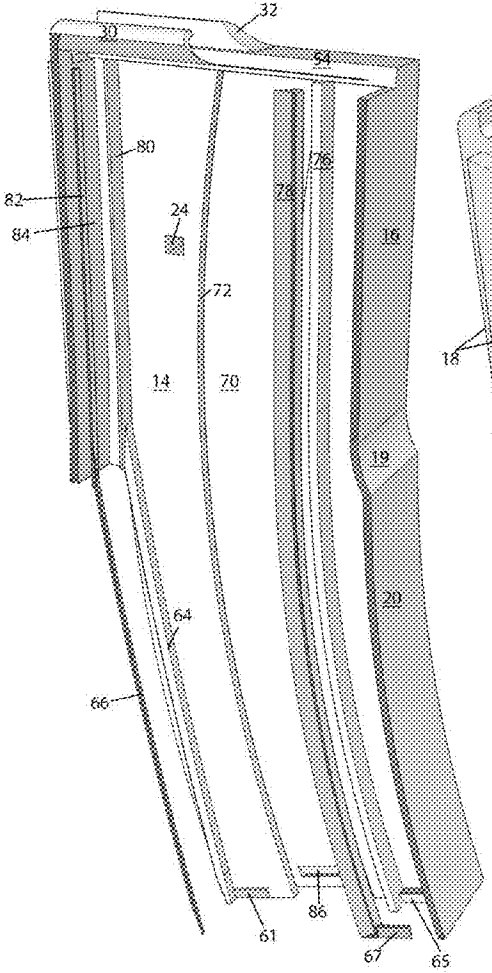
FIG. 9 is an elevational cutaway view of the internal components of a box magazine of the present disclosure.

FIG. 6 illustrates a top view of one embodiment of the magazine system with follower 52 in its top position, tab receiver slots 60 and 62, magazine feed lips 30 and 32, shell case index block 54, lower end wall 20, base 28, and magazine index tab 22. Additional illustrated components are the tops of some internal components (ref. FIGS. 9-10), follower guide/shell casing nose guide rails 76 and 78, (ref. FIG. 10).

Figure 7:
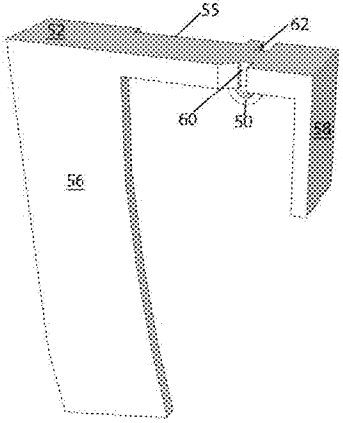
FIG. 7 is an elevational side view of the follower of FIG. 6.
Figure 8:
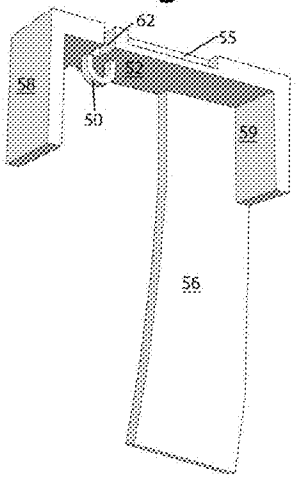
FIG. 8 is an opposing elevational side view of the follower of FIG. 6.

FIGS. 7 and 8 illustrate the follower generally as 52, end guides 58 and 59, spring torque limiter 56, shell casing nose and follower guide slots 60 and 62, travel limiter slot 55, and spring retention tab 50. The follower is improved and specifically designed to function with the present non-detachable/reloadable magazine device.

FIGS. 9 and 10 illustrate the internal box magazine system components, including base plate arched receiver pocket 70, retainer tab track 72 and 74, squeeze tab receiver lock detent 86, follower guide/shell case neck retainer tabs 76 and 78, shell casing base guide slot 84, shell casing base index tabs 80 and 82, magazine body 10 interior side wall 14, upper magazine index slot 24, end wall 18, magazine index tab 22, end wall expansion arch 19, lower expanded end wall 20, shell case index block 54, and feed lip 32.

FIG. 10 illustrates (in a semi open position) the interaction of internal box magazine 10 system components with the base assembly 28 components, rendering specifically the mating of base plate arched guide 40 with base plate arched receiver pocket 70 and the corresponding tab interaction between arched guide tabs 42 and 43, retainer tab track 72 and 74 respectively, stripper clip stop rail 64 and 66, shell case index block 54, upper magazine index slot 24, rear wall cover plate 34, rear wall cover catch tab 44, capacity limiting block 35, spring retainer tab 46, base plate 28, squeeze tab 36, and squeeze tab lock 37. FIG. 10 further illustrates an opposing view of internal components cataloged in FIG. 9.

Figure 11A:
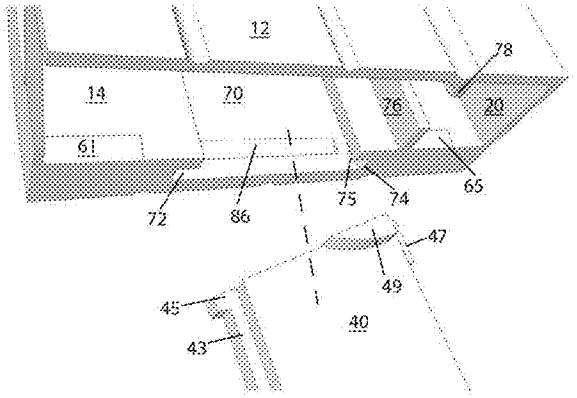
FIG. 11A is a view of the open bottom of the magazine body.
Figure 11B:
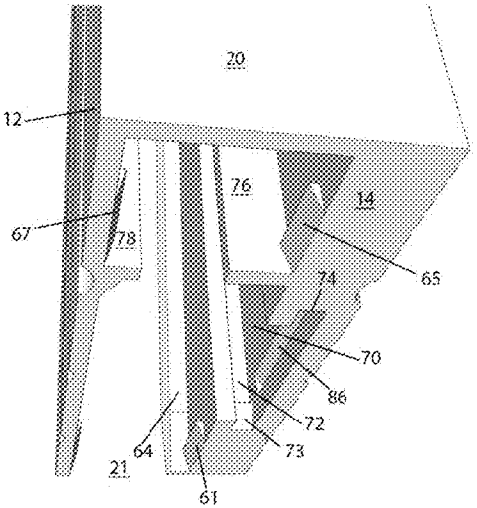
FIG. 11B is a view of the open bottom of the magazine body.

FIGS. 11A and 11B illustrate an open bottom 21 view of the internal components of magazine walls 12, 14, and 20 with an illustration of the top of base plate arched guide 40 and the stop tabs 45 and 47. Stop tabs 45 and 47 prevent the base plate arched guide from exiting from base plate arched receiver pocket 70, prevented from doing so by the corresponding stop tabs 73 and 74 located at the base of base plate arched receiver pocket 70. An additional component of base plate arched guide 40 is the travel limiter tab 49 which retains follower 52 and spring 48 relative to base plate arched guide 40 when the system is pulled in the open configuration. Without this travel limiter tab 49, follower 52 and spring 48 would naturally revert to the spring's fully extended point. This would conflict with, and hamper, the insertion of the stripper clip. FIGS. 11A and 11B further detail the squeeze tab receiver lock detent 86 unseen when the magazine system is assembled, as well as the follower stop tabs 61, 65, and 67 that prevent follower 52 from exiting the open bottom 21 during the process of reloading.

Figure 12:
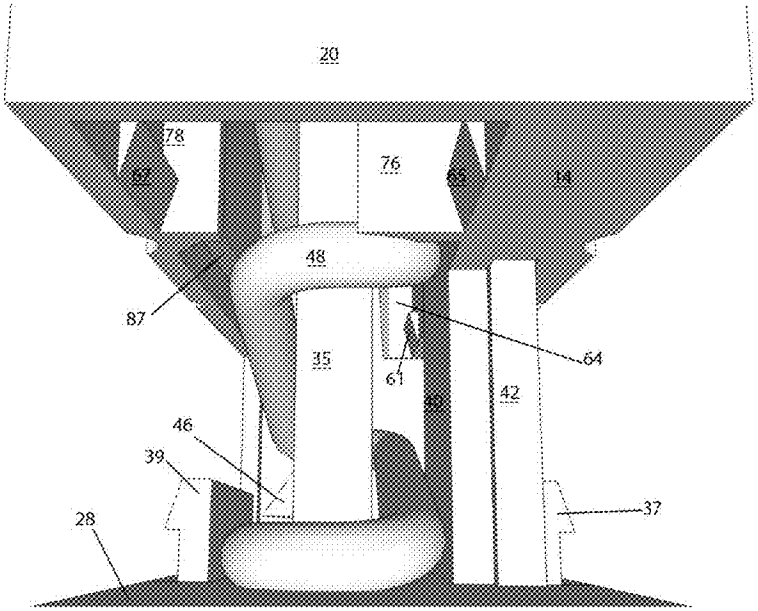
FIG. 12 is a detail view of the base plate components of the device of FIG. 1.

FIG. 12 illustrates the components of base plate assembly 28 and how they relate to corresponding components inside open bottom 21. Specifically squeeze tab locks 37 and 39 and their matching squeeze tab receiver detents 87 (and hidden 86 referred above in FIGS. 11A and 11B). Further illustrations detail spring 48 retention tab 46, follower guide/shell casing neck retainer rails 76 and 78, follower stop tabs 65 and 67, and capacity limiting block 35, including how it provides center support to spring 48.

Figure 13:
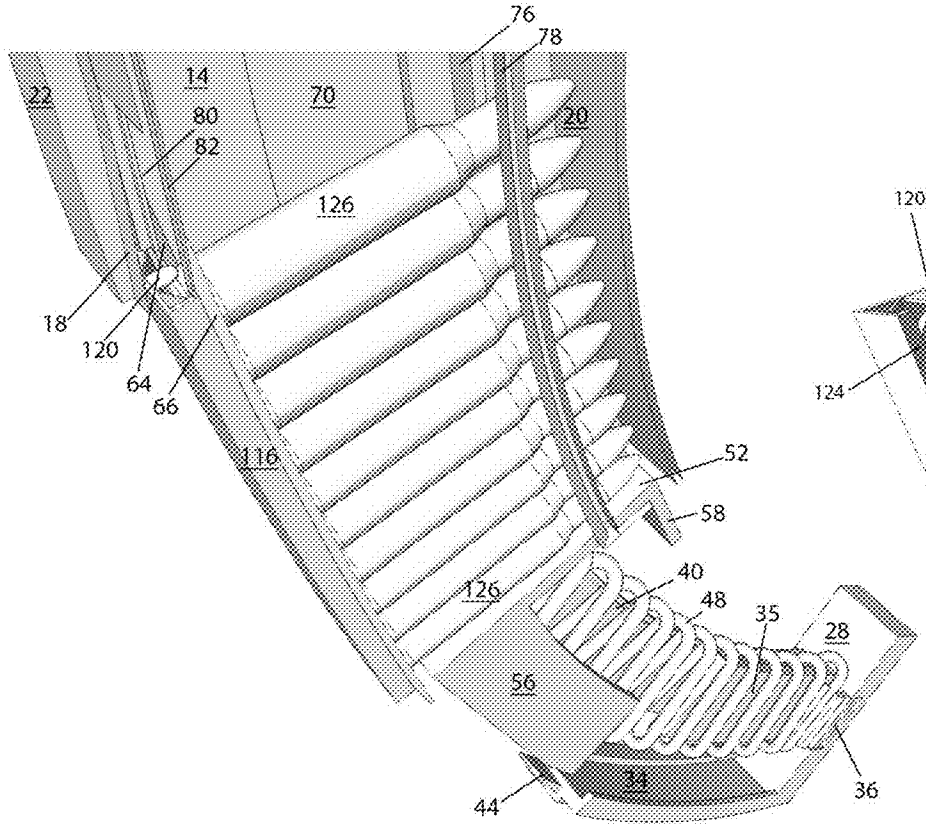
FIG. 13 depicts a stripper clip assembly installed in the open magazine chamber of the device of FIG. 1.

FIG. 13 illustrates the open magazine, as a cut away, skewed plan view, illustrating a stripper clip assembly 116 inserted into the magazine system chamber, as well as the manner in which stripper clip 116 components 122 and 124 (identified in FIG. 14) match internal magazine components 82 and 84 (not shown), how stripper clip 116 rests against stripper clip stop rails 64 and 66, and the method of indexing provided by follower guide/shell case neck retainer rails 76 and 78.

Figure 14:
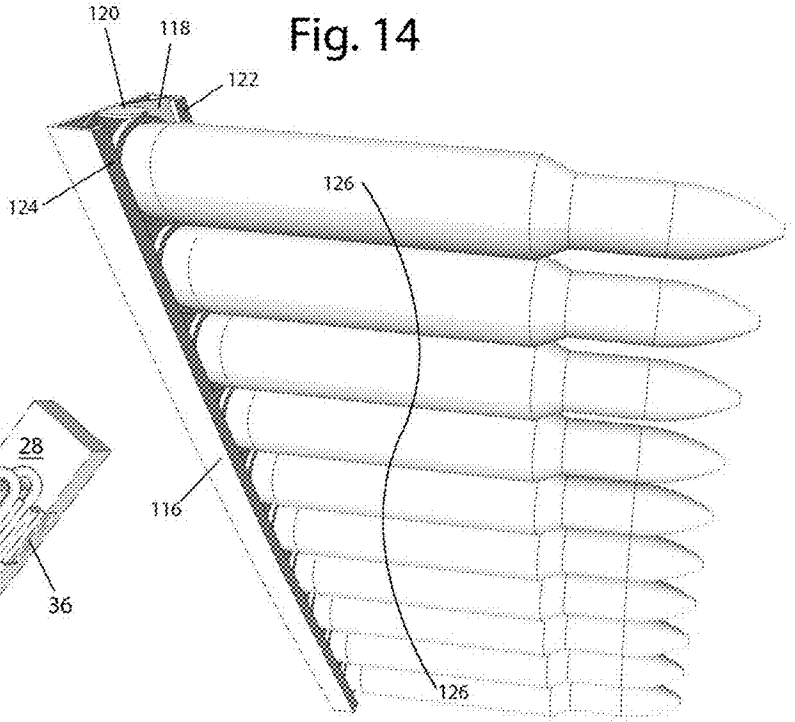
FIG. 14 illustrates a stripper clip assembly.

FIG. 14 illustrates a commercially-available preloaded stripper clip 116 containing ten rounds of ammunition. Stripper clip 116 includes brass spring device 118, end tab 120, retainer rails 122 and 124, and shell casings 126.

Figures 15, 16A, 16B, 17A, 17B:
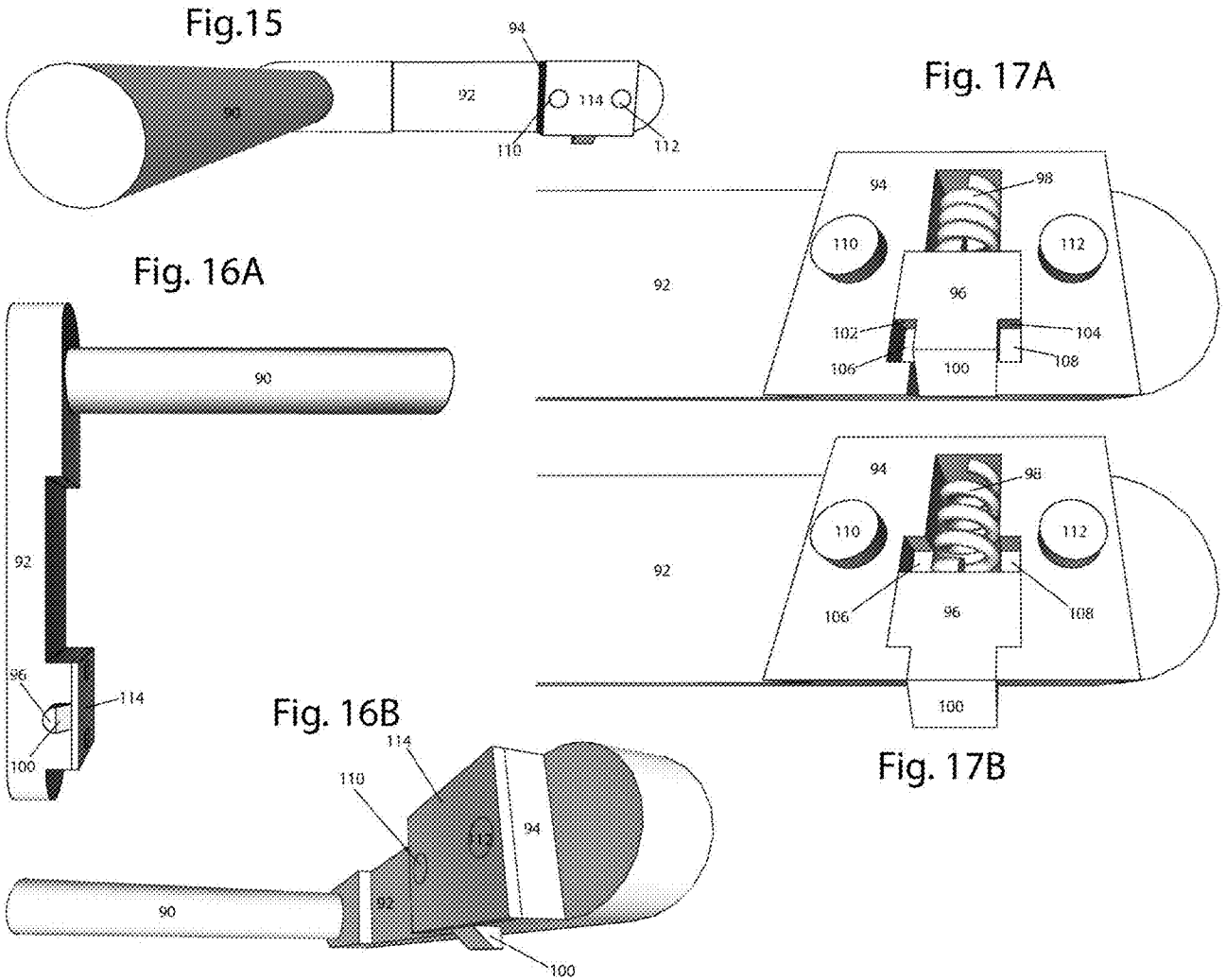
FIG. 15 is a view of a magazine locking device for use with a box magazine of the present disclosure.
FIG. 16A is an additional view of a magazine locking device for use with a box magazine of the present disclosure.
FIG. 16B is an additional view of a magazine locking device for use with a box magazine of the present disclosure.
FIGS. 17A and 17B provide cutaway perspectives of the internal components of the locking device of FIG. 15.

FIG. 15 illustrates the locking device, depicting threaded rod 90, spanner arm 92, tab 94 lock detent 96 and cover plate 114. FIGS. 16A and 16B show alternative view of the locking device assembly of FIG. 15. The locking device includes a threaded rod 90, span arm 92, tab 94, detent pin 96, sloped face 100, tension spring 98, inter locking tabs 102, 104, 106 and 108, compression studs 110 and 112, and cover plate 114.

FIGS. 17A and 17B illustrate the locking device inner components, such as detent pin 96, tension spring 98, sloped face 100, interlocking tabs 102 and 104, corresponding tab receiver slots 106 and 108, and compression studs 110 and 112.

Figure 20:
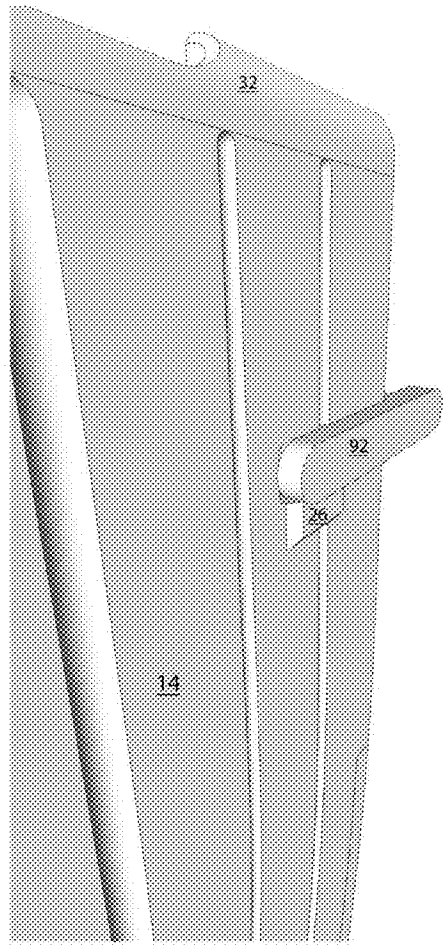
FIGS. 18, 19, and 20 illustrate the magazine wall components of a device of the present invention as they relate to the locking device of FIG. 15.
Figure 19:
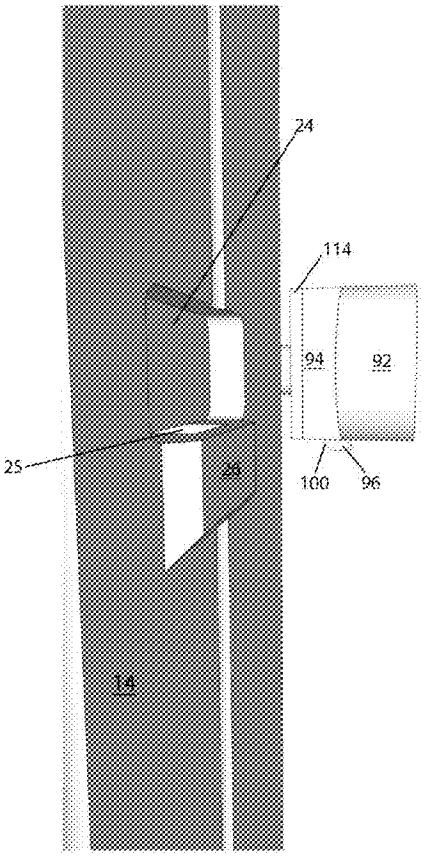
Figure 18:
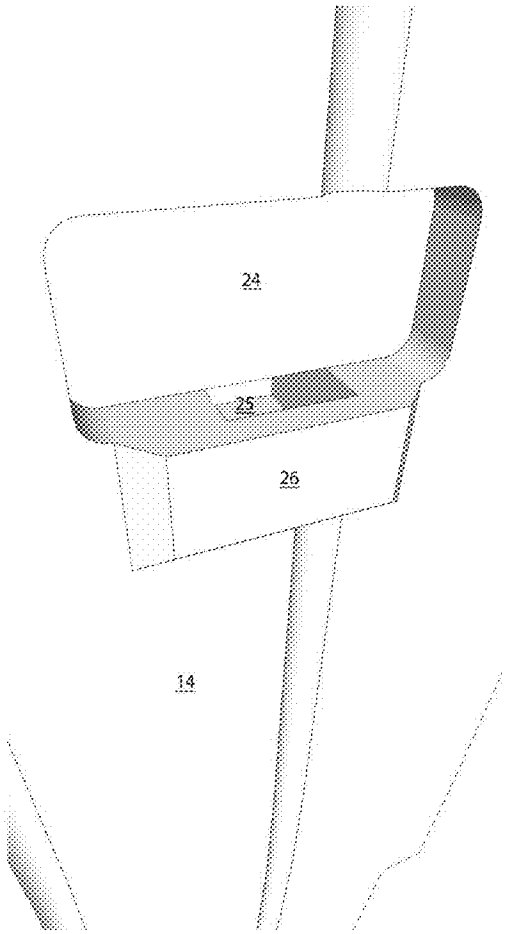

FIGS. 18, 19, and 20 illustrate the upper magazine index slot, stop tab 26, detent slot 25 as it relates to the locking device function, tab 94, detent pin 96, slope face 100, and spanner arm 92, securing the non-detachable/reloadable magazine system to the carbine type rifle.

One embodiment of a non-detachable reloadable box magazine device requires a locking device to be installed on the carbine type rifle. FIGS. 15, 16A, 16B, 17A, and 17B, described above, depict various features of one embodiment of such a locking device. Designed similarly to a non-locking commercially available magazine release assembly, this improved design, once installed, does not allow the box magazine system device to be removed without significant effort requiring the opening of the rifle's action and the use of a tool to pull up on the locking detent.

The locking device prevents removal of the magazine system by utilizing a detent pin 96, sloped face 100, interlocking tabs 102 and 104, corresponding to tab receiver slots 106 and 108 respectively and locking tab spring 98 all secured behind a cover plate 114, attached to tab 94 by compression studs 110 and 112 through matching holes in cover plate 114.

As indicated above, FIGS. 18, 19, and 20 illustrate the components of magazine wall 14 with upper magazine index slot 24, detent slot 25, stop tab 26, and how they relate to the components of the locking device. As the magazine is inserted into the rifle's magazine well, stop tab 26 forces detent pin 96 up into tab 94. The locking device then slams into upper magazine slot 24 and detent pin 96 drops into detent slot 25, effectively locking the non-detachable reloadable magazine system securely to the carbine type rifle.

Once installed on the rifle using an additional commercially available spring and push button nut, it prevents the removal of this non-detachable reloadable magazine device.

One alternative embodiment of the present disclosure is now described.

Figure 22:
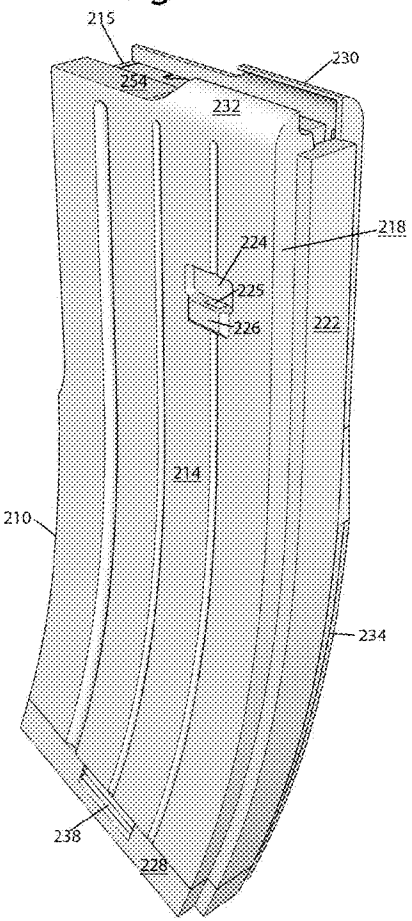
FIG. 22 is an opposing elevational side view of the non-detachable, reloadable box magazine system of FIG. 21.
Figure 21:
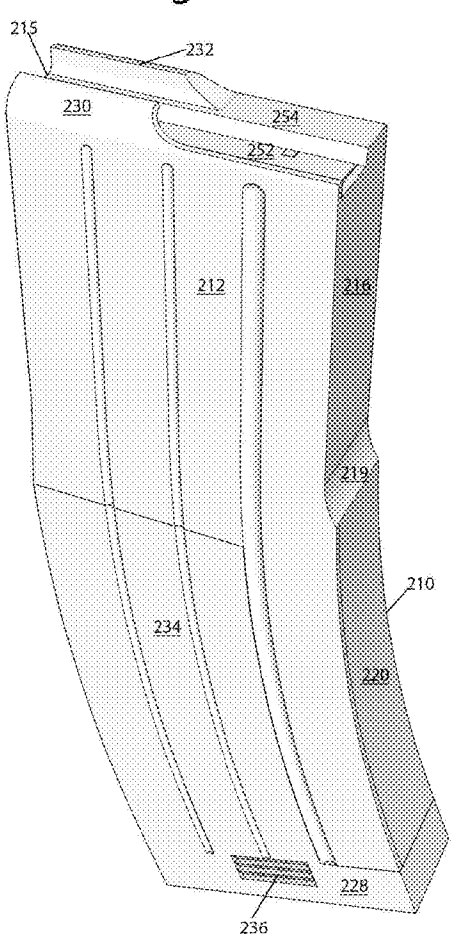
FIG. 21 is a side elevational view of an alternate embodiment of a non-detachable, reloadable box magazine of the present disclosure.

FIGS. 21 and 22 illustrate opposing views of an embodiment of the magazine system in the closed configuration as a box magazine body indicated generally as 210 in having side walls 212 and 214, mutually opposing end walls 216 and 218, open top 215 with curved feed lips 230 and 232, a base plate 228, with upper magazine index slot 224, detent slot 225, stop tab 226, and magazine index tab 222. The shape of the box magazine 210 is that of an arched box. The end walls 216 and 218 is expanded in the lower arched section in by expansion arch 219 and lower expanded end wall 220, to allow clearance for the preloaded 10 round ammunition stripper clip.

Figure 23:
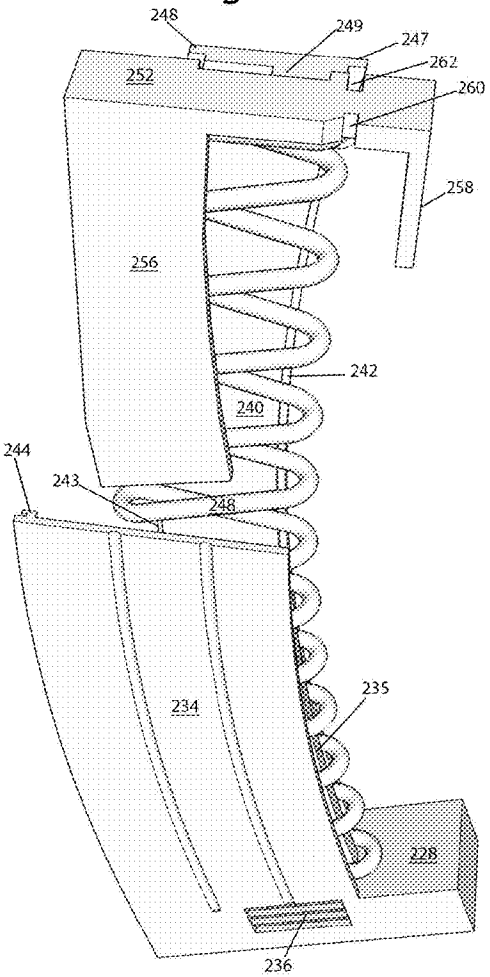
FIG. 23 is an elevational view of the internal components of the base assembly of the non-detachable, reloadable box magazine system of FIG. 21.

FIG. 23 illustrates the internal components of the embodiment of the magazine system, including the base plate 228, squeeze tab 238, squeeze tab lock 237, grip tab 236, spring retaining tab 246, side magazine wall cover 234, side wall cover guide rail 244, base plate arched guide 240, arched guide tabs 242 and 243, spring 248, follower, indicated generally as 252, (see FIGS. 27 and 28 for detail), follower spring tab 250 (shown in FIG. 28), follower end guides 258 and 259 (shown in FIG. 28), spring torque limiter 256, tab receiver slots 260 and 262 and capacity limiting block 235.

Figure 24:
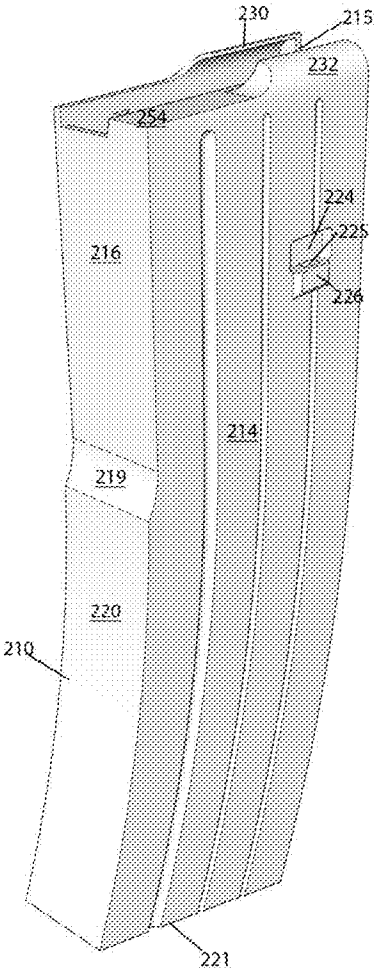
FIG. 24 is an elevational view of the magazine body of the device of FIG. 21, without the internal components of the device.

FIG. 24 illustrates the magazine body 210 absent the internal system components of FIG. 23.

Figure 25:
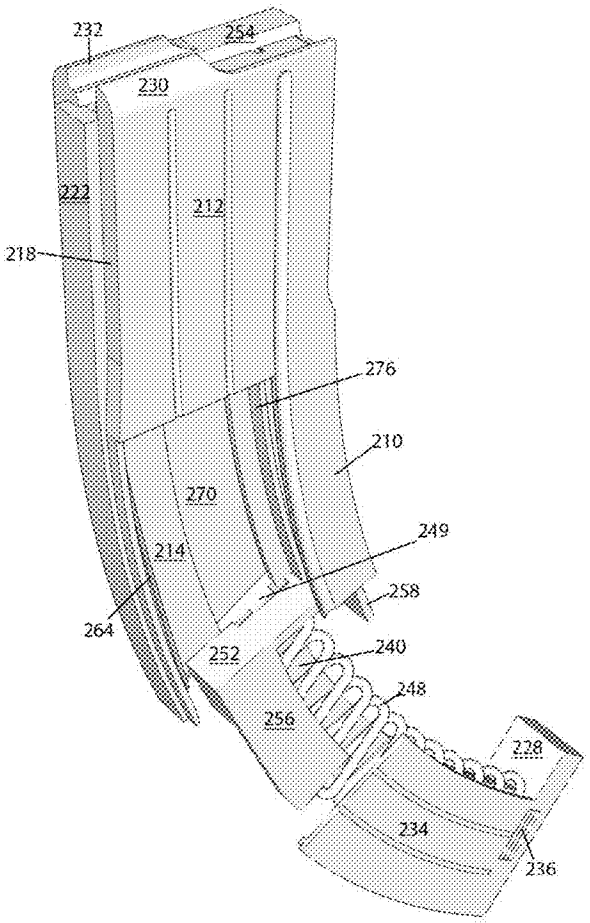
FIG. 25 is an elevational view of the non-detachable, reloadable magazine system of FIG. 21 in its fully open position.

FIG. 25 illustrates the system components (described in FIGS. 1, 2, and 3) together in the open configuration.

Figure 26:
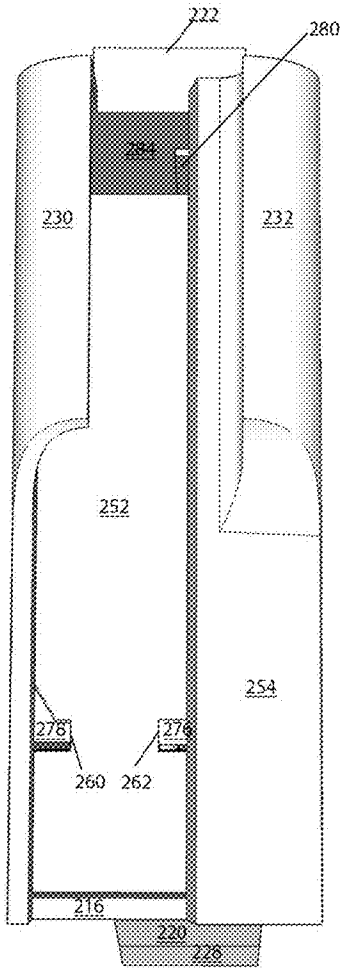
FIG. 26 is a top view of the magazine body of FIG. 21 showing the follower in its top most position.
Figure 30:
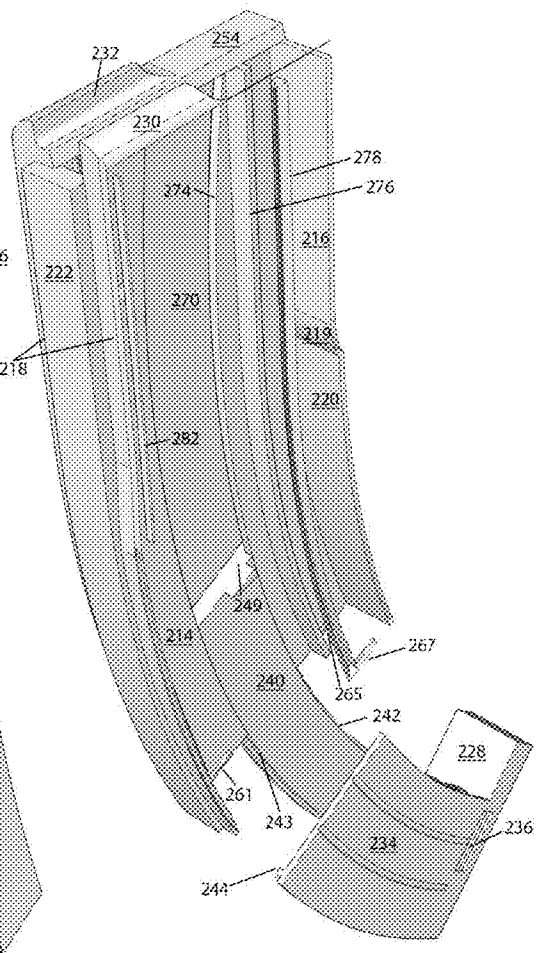
FIG. 30 is an elevational cutaway view of the internal components of the device of FIG. 21 showing the function of the base plate assembly in relation to the box magazine body.
Figure 29:
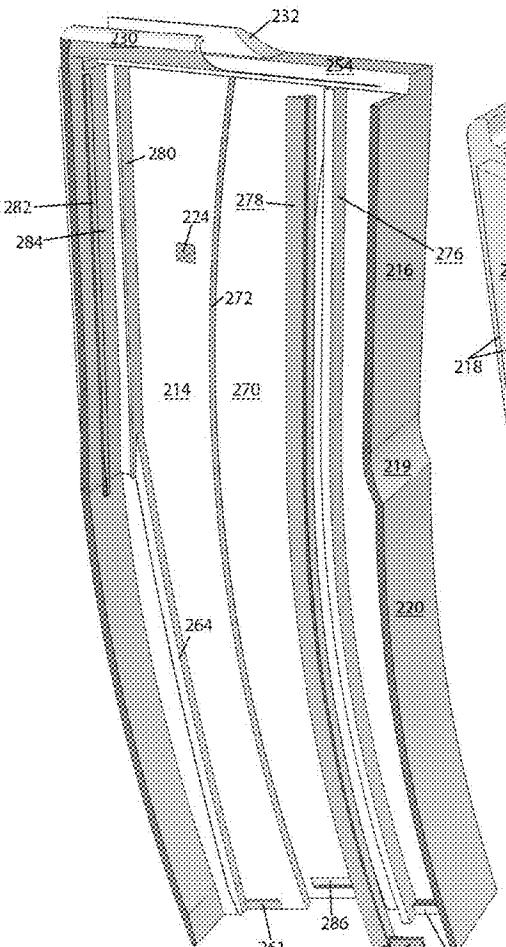
FIG. 29 is an elevational cutaway view of the internal components of the box magazine of FIG. 21.

FIG. 26 illustrates a top view of the magazine system with follower 252 in its top position, tab receiver slots 260 and 262, magazine feed lips 230 and 232, shell case index block 254, lower end wall 220, base 228, end wall 216 and shell casing base guide slot 284, and magazine index tab 222. Additional illustrated components are the tops of some internal components (ref. FIGS. 29 and 30), including follower guide/shell casing nose guide rail 276 and 278.

Figure 27:
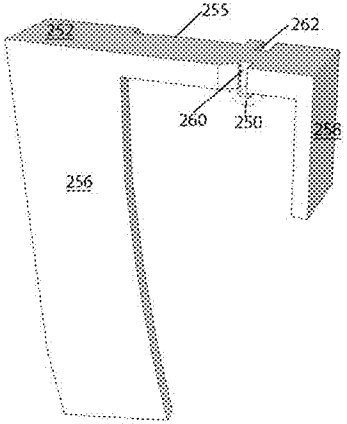
FIG. 27 is an elevational side view of the follower of the device of FIG. 21.
Figure 28:
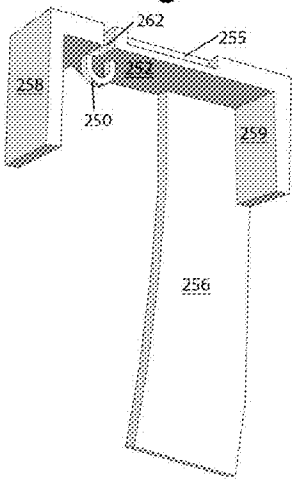
FIG. 28 is an opposing elevational side view of the follower of the device of FIG. 21.

FIGS. 27 and 28 illustrate the follower generally as 252, end guides 258 and 259, spring torque limiter 256, shell casing nose and follower guide slots 260 and 262, travel limiter slot 255, and spring retention tab 250. The follower is improved and specifically designed to function with the present non-detachable/reloadable magazine device.

FIGS. 29 and 30 illustrates the internal box magazine system components of an embodiment of the present device comprising: base plate arched receiver pocket 270, retainer tab track 272, squeeze tab receiver lock detent 286, follower stop tabs 261, 265, and 267, follower guide/shell case neck retainer rails 276 and 278, shell casing base guide slot 284, shell casing base index tabs 280 and 282, stripper clip stop 264, magazine body 210 interior side wall 214, upper magazine index slot 224, end wall 216, end wall expansion arch 219, lower expanded end wall 220, shell case index block 254, and feed lips 230 and 232.

FIG. 30 illustrates (in a semi open position) the interaction of internal box magazine 210 system components with the base assembly 228 components rendering specifically the mating of base plate arched guide 240 with base plate arched receiver pocket 270 and the corresponding tab interaction between arched guide tabs 242 and 243 with retainer tab tracks 272 (not seen) and retainer tab track 274. Other components include: grip tab 236, side wall cover plate 234, side wall cover guide rail 244, follower stop tab 265, magazine end wall 218, magazine index tab 222, and capacity limiting block 235. FIG. 30 further illustrates an opposing view of internal components depicted in FIG. 29 including: shell casing base index rail 282, end wall 216, expansion arch 219, lower magazine end wall 220, interior side wall 214, follower guide/shell case neck retainer rails 276 and 278, feed lips 230 and 232, follower stop tabs 265 and 267, follower guide/shell case neck rails 276 and 278, and shell case index block 254.

Figure 31A:
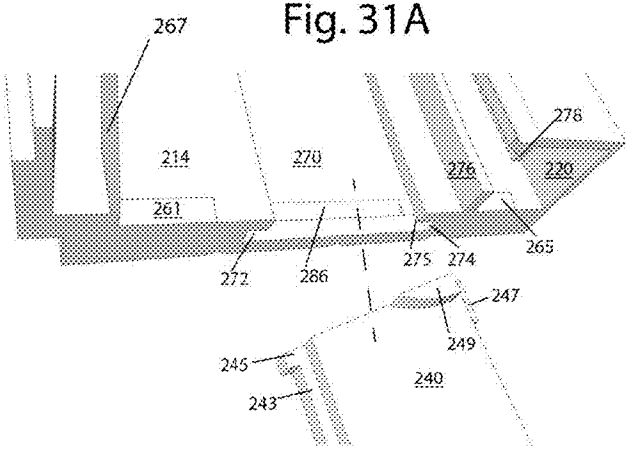
FIGS. 31A and 31B are views of the open bottom of the magazine body of the device of FIG. 21.
Figure 31B:
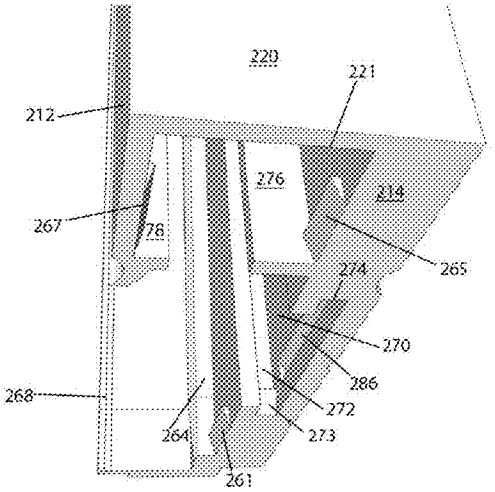

FIGS. 31A and 31B illustrate an open bottom 221 view of the internal components of magazine walls 214 and 220 with an illustration of the top of base plate arched guide 240 and the arched guide stop tabs 245 and 247. Arched guide stop tabs 245 and 247 prevent the base plate arched guide from exiting from base plate arched receiver pocket 270, prevented from doing so by the corresponding stop tabs 273 and 275 located at the base of base plate arched receiver pocket 270. The figures also illustrates the follower stop tabs 261, 265, and 267. The tabs prevent the follower 252 from exiting out of the open base 221 when the base magazine system is in the fully open position. An additional component of base plate arched guide 240 is the travel limiter tab 249, which retains follower 252 and spring 248 relative to base plate arched guide 240 when the system is pulled in the open configuration. Without this travel limiter tab 249, follower 252 and spring 248 would naturally revert to the springs fully extended point. This would conflict and hamper the insertion of the stripper clip assembly 316.

FIGS. 31A and 31B further detail the squeeze tab receiver lock detent 286 unseen when the magazine system is assembled, as well as the follower stop tabs 261, 265, and 267 that prevent follower 252 from exiting the open bottom 221 during the process of reloading.

Figure 32:
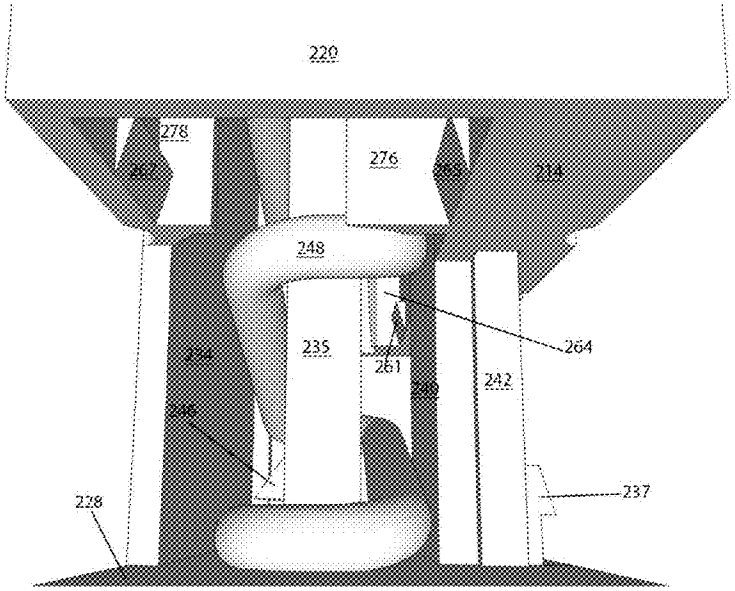
FIG. 32 is a detail view of the base plate components of the device of FIG. 21.

FIG. 32 illustrates the components of base plate assembly 228 and how they relate to corresponding components inside open bottom 221. Specifically squeeze tab lock 238 and their matching squeeze tab receiver detents 286. Further illustrations detail spring 248 retention tab 246, follower guide/shell casing neck retainer rails 276 and 278, follower stop tabs 261, 265, and 267, and capacity limiting block 235, and how it provides center support to spring 248.

Figure 33:
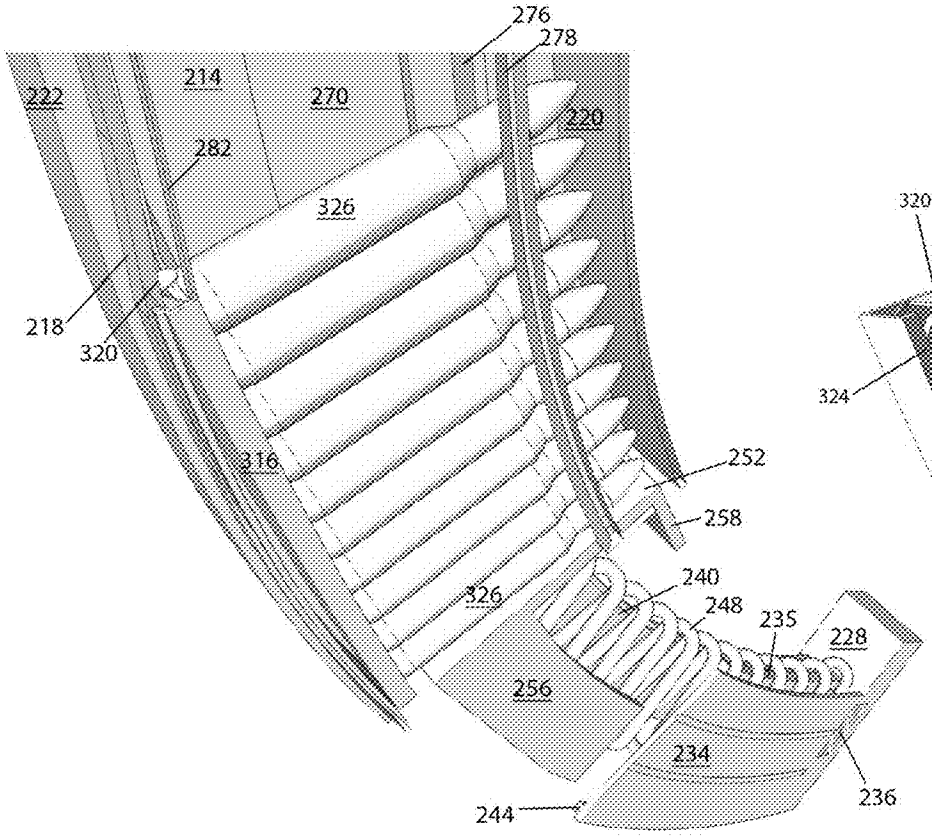
FIG. 33 depicts the stripper clip assembly installed in the open magazine chamber of the device of FIG. 21.

FIG. 33 illustrates the open magazine, as a cut away, skewed plan view, illustrating the stripper clip assembly generally as 316 inserted into the magazine system chamber and the manner in which stripper clip 316 components 322 and 324 (shown in FIG. 34) match internal magazine components 282 and 284, how stripper clip 316 rests against stripper clip stop rail 264 and 266, and the method of indexing provided by follower guide/shell case neck retainer tabs 276 and 278.

Figure 34:
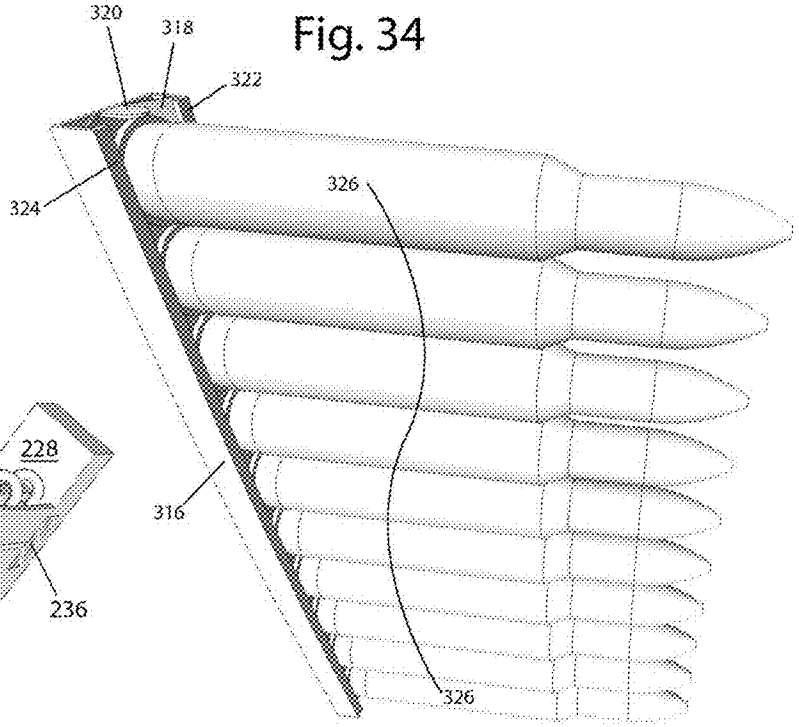
FIG. 34 illustrates an embodiment of the stripper clip assembly of the device of FIG. 21.

FIG. 34 illustrates a commercially available preloaded stripper clip containing ten rounds of ammunition generally noted as 316. Stripper clip 316, brass spring device 318, end tab 320, retainer rails 322 and 324, and shell casings referred generally as 326.

Figures 35, 36A, 36B, 37A, 37B:
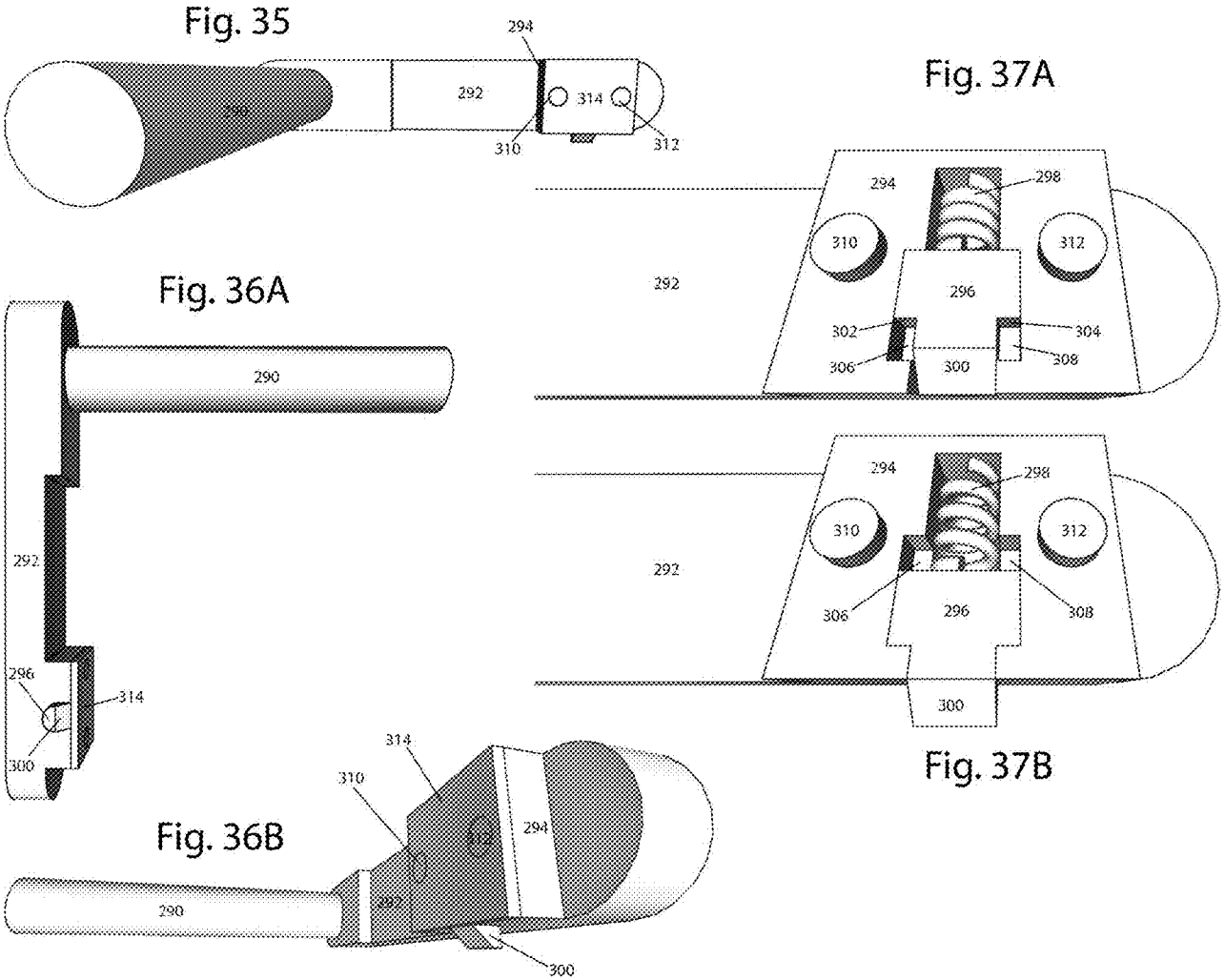
FIG. 35 is a view of an embodiment the magazine locking device of the device of FIG. 21.
FIGS. 36A and 36B depict other views of the magazine locking device of FIG. 35.
FIGS. 37A and 37B provide cutaway perspectives of the internal components of the locking device of FIG. 35.

FIGS. 35, 36A, and 36B illustrate the locking device from multiple angles and includes a threaded rod 290, spanner arm 292, tab 294, detent pin 296, and cover plate 314.

FIGS. 37A and 37B illustrate the locking device inner components, such as detent pin 296, tension spring 298, sloped face 300, interlocking tabs 302 and 304, corresponding tab receiver slots 306 and 308, compression studs 310 and 312, and cover plate 314. Also shown are span arm 292, tab 294, sloped face 300, tension spring 298, and inter locking tabs 302, 304, 306, and 308.

Figure 40:
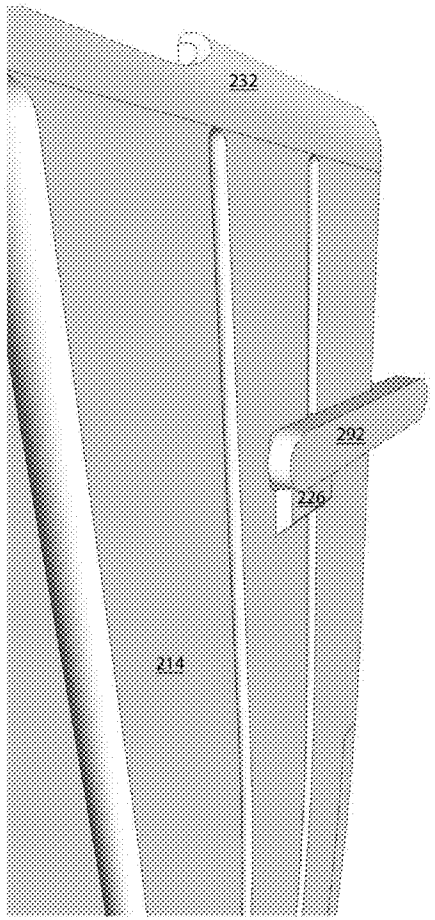
FIGS. 38, 39, and 40 illustrate the magazine wall components of the device of FIG. 21 as they relate to the locking device of FIG. 35.
Figure 39:
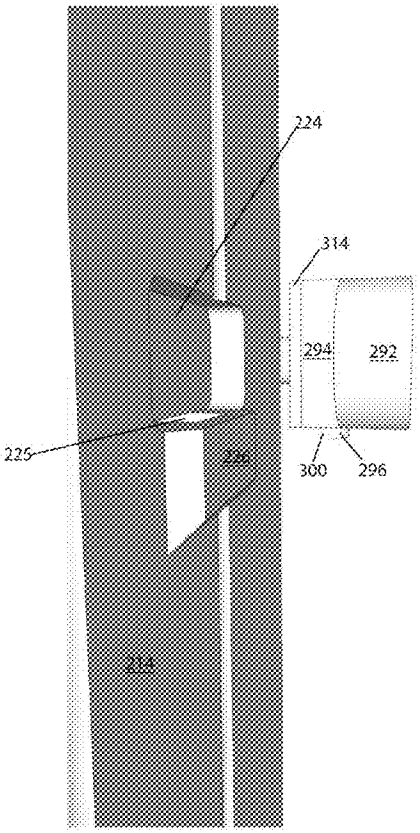
Figure 38:
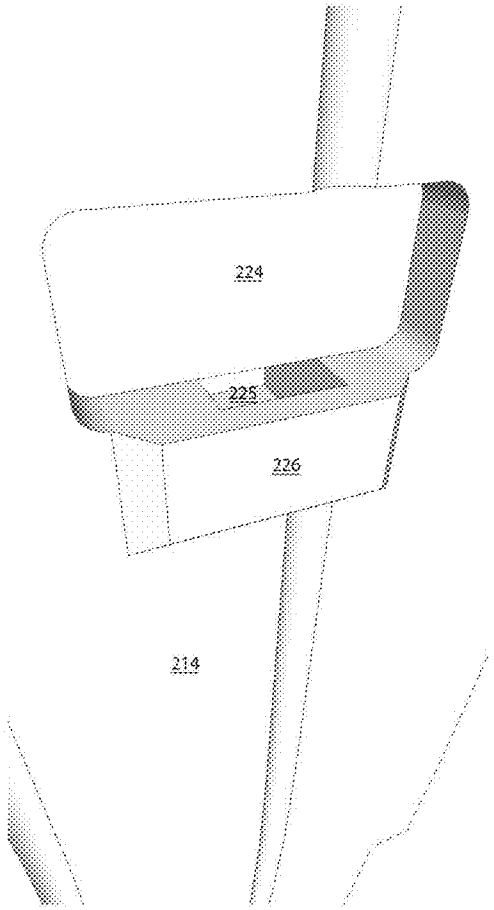

FIGS. 38, 39, and 40 illustrate the upper magazine index slot, stop tab 226, detent slot 225 as it relates to the locking device function, tab 294, detent pin 296, slope face 300, and spanner arm 292, securing the non-detachable/reloadable magazine system to the carbine type rifle.

This embodiment of a non-detachable reloadable box magazine device requires a locking device to be installed on the carbine type rifle. As noted above, FIGS. 35, 36A, 36B, 37A, and 37B depict an embodiment of such a locking device. Designed similarly to a non-locking commercially available magazine release assembly, this improved design, once installed, does not allow the box magazine system to be removed without significant effort requiring the opening of the rifles action and the use of a tool to pull up on the locking detent.

The locking device prevents removal of the magazine system by utilizing a detent pin 296, sloped face 300, interlocking tabs 302 and 304, corresponding to tab receiver slots 306 and 308 respectively, and locking tab spring 298, all secured behind a cover plate 314, attached to tab 294 by compression studs 310 and 312 through matching holes in cover plate 314.

FIG. 38 illustrates the components of magazine wall 214 with upper magazine index slot 224, detent slot 225, stop tab 226 and how they relate to the components of the locking device 292. As the magazine is inserted into the rifle's magazine well, stop tab 226 forces detent pin 296 up into tab 294. The locking device 292 then slams into upper magazine slot 224 and detent pin 296 drops into detent slot 225 effectively locking the non-detachable reloadable magazine system securely to the carbine type rifle.

Once installed on the rifle using additional commercially available spring and push button nut it prevents the removal of this non-detachable reloadable magazine invention.

Another alternative embodiment of the present disclosure is now described.

Figure 42:
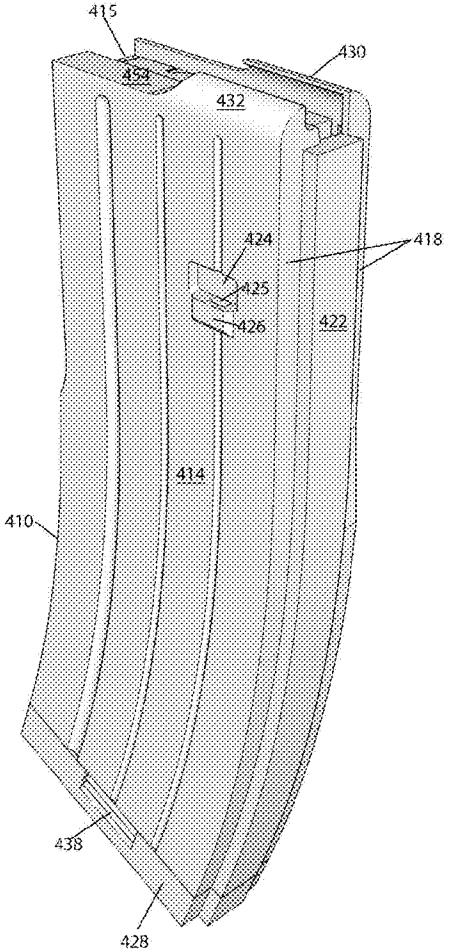
FIG. 42 is an opposing elevational side view of the non-detachable, reloadable box magazine system of FIG. 41.
Figure 41:
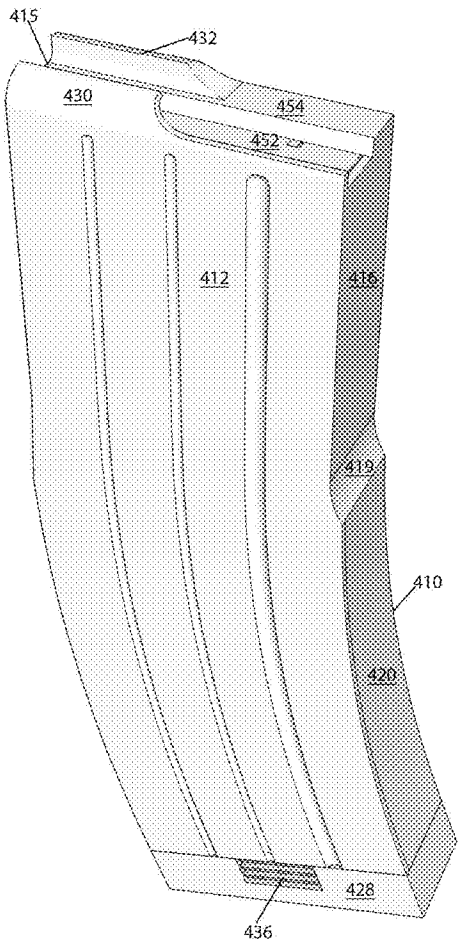
FIG. 41 is a side elevational view of a second alternative embodiment of the non-detachable, reloadable box magazine of the present disclosure.

FIGS. 41 and 42 illustrate opposing views of another alternative embodiment of the magazine system of the present disclosure in a closed configuration as a box magazine body, indicated generally as 410, and having side walls 412 and 414, mutually opposing end walls 416 and 418, open top 415 with curved feed lips 430 and 432, a base plate 428, with upper magazine index slot 424, stop tab 426, and magazine index tab 422. The shape of the box magazine 410 is that of an arched box. The end walls 416 and 418 are expanded in the lower arched section by expansion arch 419 and lower expanded end wall 420, to allow clearance for the preloaded ten round ammunition stripper clip.

Figure 43:
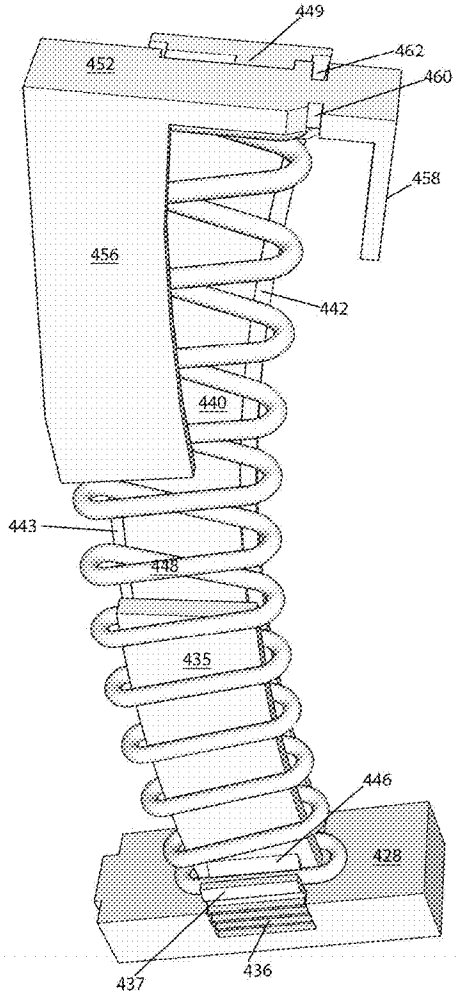
FIG. 43 is an elevational view of the internal components of the base assembly of the non-detachable, reloadable box magazine system of FIG. 41.

FIG. 43 illustrates the internal components of the magazine system, including the base plate 428, squeeze tabs 436 and 438, squeeze tab Lock 437, spring retaining tab 446, base plate arched guide 440, arched guide tabs 442 and 443, spring 448, follower, indicated generally as 452, (see FIGS. 47 and 48 for detail) follower spring tab 450, follower end guides 458 and 459 (see FIG. 48), spring torque limiter 456, tab receiver slots 460, and 462 and capacity limiting block 435.

Figure 44:
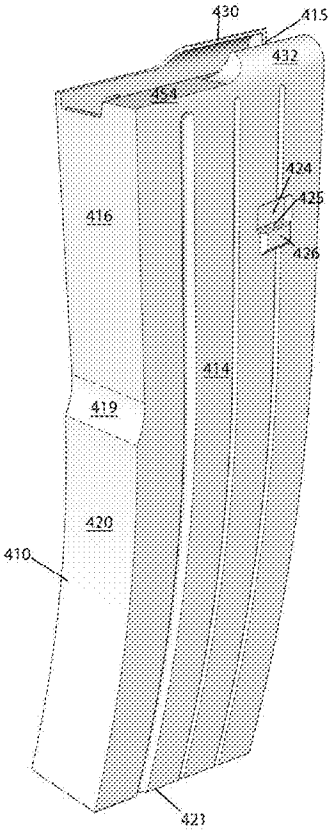
FIG. 44 is the elevational view of the magazine body of FIG. 41, without the internal components of FIG. 43.

FIG. 44 illustrates the magazine body 410 absent the internal system components of FIG. 43.

Figure 45:
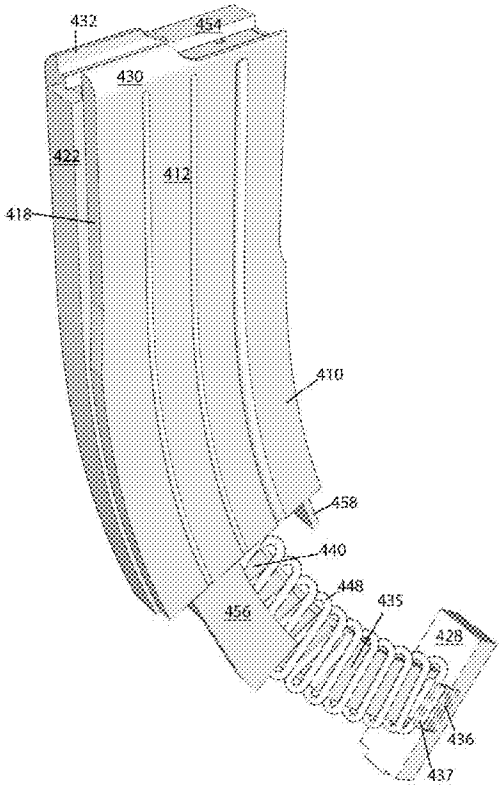
FIG. 45 is an elevational view of the non-detachable, reloadable magazine system of FIG. 41 in its fully open position.

FIG. 45 illustrates the system components (described in FIGS. 41, 42 and 43) together in the open configuration.

Figure 46:
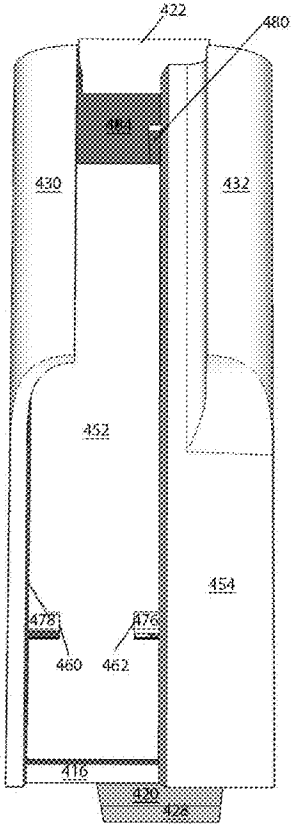
FIG. 46 is a top view of the magazine body of FIG. 41, showing the follower in its top most position.
Figure 50:
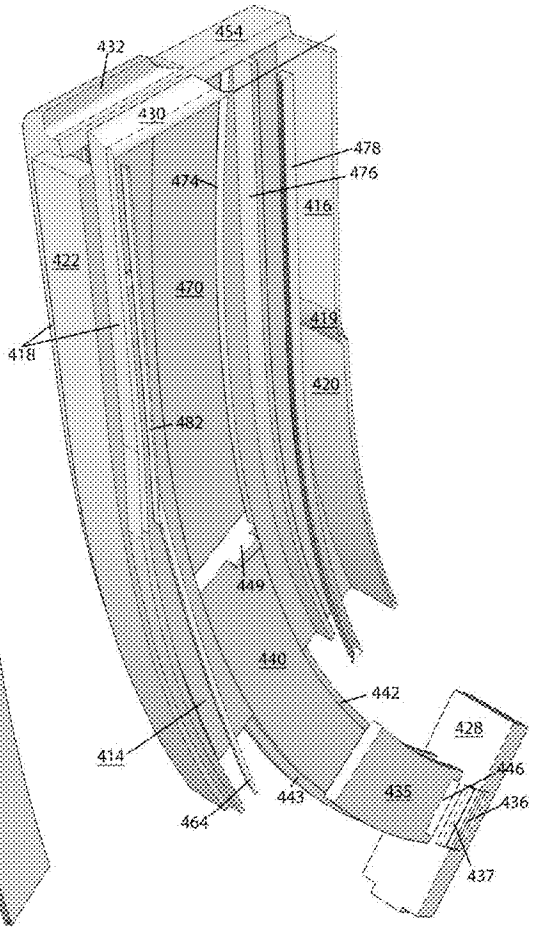
FIG. 50 is an elevational cutaway view of the internal components of the magazine body of FIG. 46 showing the function of the base plate assembly in relation to the box magazine body.
Figure 49:
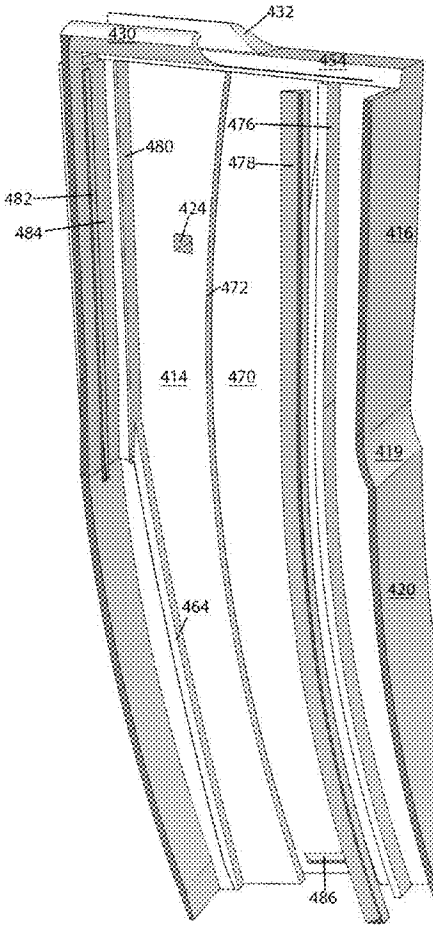
FIG. 49 is the elevational cutaway view of the internal components of the box magazine of FIG. 41.

FIG. 46 illustrates the top view of the embodiment of the magazine system with follower 452 in its top position, tab receiver slots 460 and 462, magazine feed lips 430 and 432, shell case index block 454, end wall 416, lower end wall 420, base 428, and magazine index tab 422. Additional illustrated components are the tops of some internal components (ref. FIGS. 49-50): follower guide/shell casing nose guide tabs 476 and 478, shell casing base guide slot 480, and shell casing base index tab 480 (Ref. FIG. 50).

Figure 47:
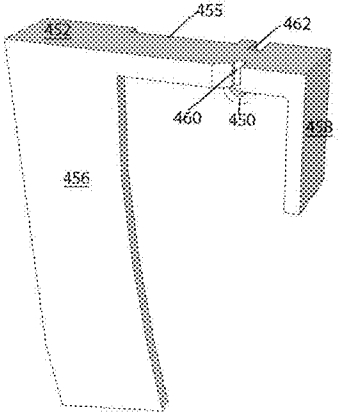
FIG. 47 is an elevational side view of the follower of FIG. 46.
Figure 48:
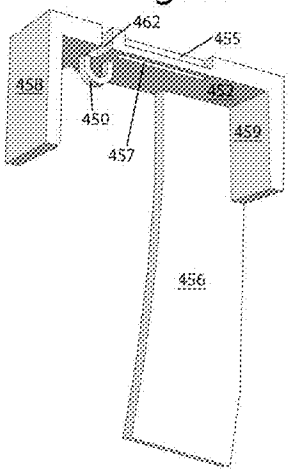
FIG. 48 is an opposing elevational side view of the follower of FIG. 46.

FIGS. 47 and 48 illustrate the follower generally as 452, end guides 458 and 459, spring torque limiter 456, shell casing nose and follower guide slots 460 and 462, travel limiter slot 455, receiver lock slot 457, and spring retention tab 450. The follower is improved and specifically designed to function of with the present non-detachable/reloadable magazine device.

FIGS. 49 and 50 illustrate the internal box magazine system components of one embodiment of the present device, including: base plate arched receiver pocket 470, retainer tab track 472, squeeze tab receiver lock detent 486, follower guide/shell case neck retainer rails 476 and 478, shell casing base guide slot 484, shell casing base index tabs 480 and 482, stripper clip stop tab 464, magazine body 410, interior side wall 414, upper magazine index slot 424, end wall 418, end wall 416, end wall expansion arch 419, lower expanded end wall 420, shell case index block 454, and feed lips 430 and 432.

FIG. 50 illustrates (in a semi open position) the interaction of internal box magazine 410 system components with the base assembly 428 components rendering specifically the mating of base plate arched guide 440 with base plate arched receiver pocket 470 and the corresponding tab interaction between arched guide tabs 442 and 443, retainer tab track 472 (not shown) and 474, stripper clip stop rail 464, shell case index block 454, capacity limiting block 435, spring retainer tab 446, base plate 428, squeeze tab 436, and squeeze tab lock 437. FIG. 50 further illustrates an opposing view of internal components cataloged in FIG. 49 including: shell casing base index rail 482, end wall 416, expansion arch 419, lower magazine end wall 420, interior side wall 414, follower guide/shell case neck retainer rails 476 and 478, feed lips 430 and 432, end wall 418, and magazine index tab 422.

Figure 51A:
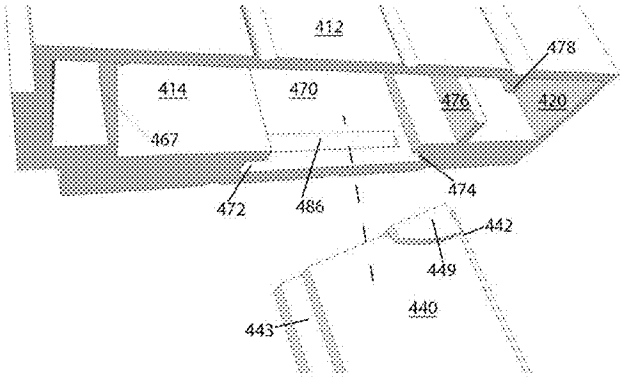
FIGS. 51A and 51B are views of the open bottom of the magazine body of FIG. 46.
Figure 51B:
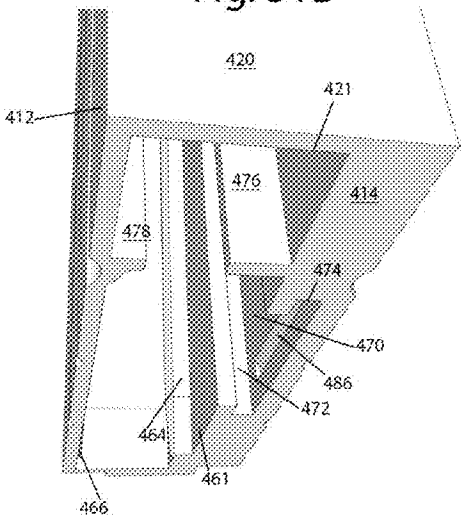

FIGS. 51A and 51B illustrate an open bottom 421 view of the internal components of magazine walls 414, 418, and 420 with an illustration of the top of base plate arched guide 440. An additional component of base plate arched guide 440 is the travel limiter tab 449 and travel limiter catch tab 461 which retains follower 452 and spring 448 relative to base plate arched guide 440 when the system is pulled out of the magazine body. Without this travel limiter tab 449 and travel limiter catch tab 461, follower 452 and spring 448 would naturally revert to the springs fully extended point. This would conflict and hamper the insertion of the stripper clip 516. The figures further detail the squeeze tab receiver lock detent 486 unseen when the magazine system is assembled.

Figure 52:
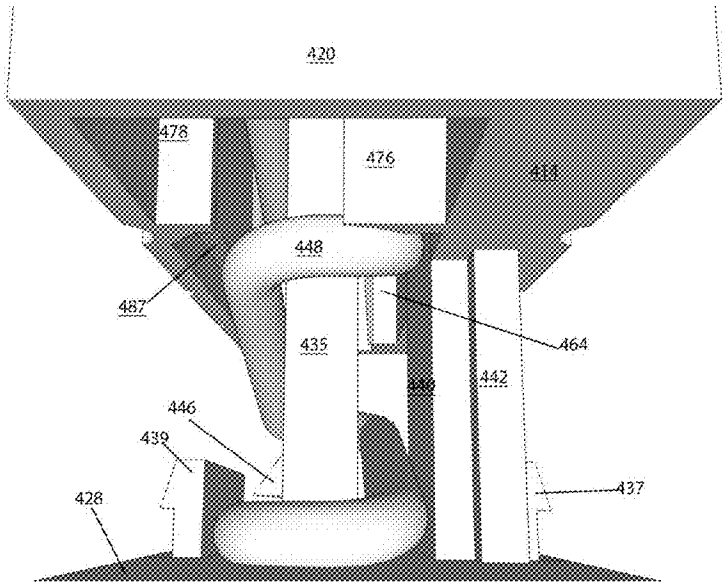
FIG. 52 is a detail view of the base plate components of the device of FIG. 41.

FIG. 52 illustrates the components of base plate assembly 428 and how they relate to corresponding components inside open bottom 421. Specifically squeeze tab locks 437 and 439 and their matching squeeze tab receiver detents 487 (and squeeze tab receiver lock detent 486, not shown but referred to above in FIG. 51). Further illustrations detail spring 448 retention tab 446, follower guide/shell casing neck retainer rails 476 and 478, and capacity limiting block 435 and how it provides center support to spring 448.

Figures 53, 54:
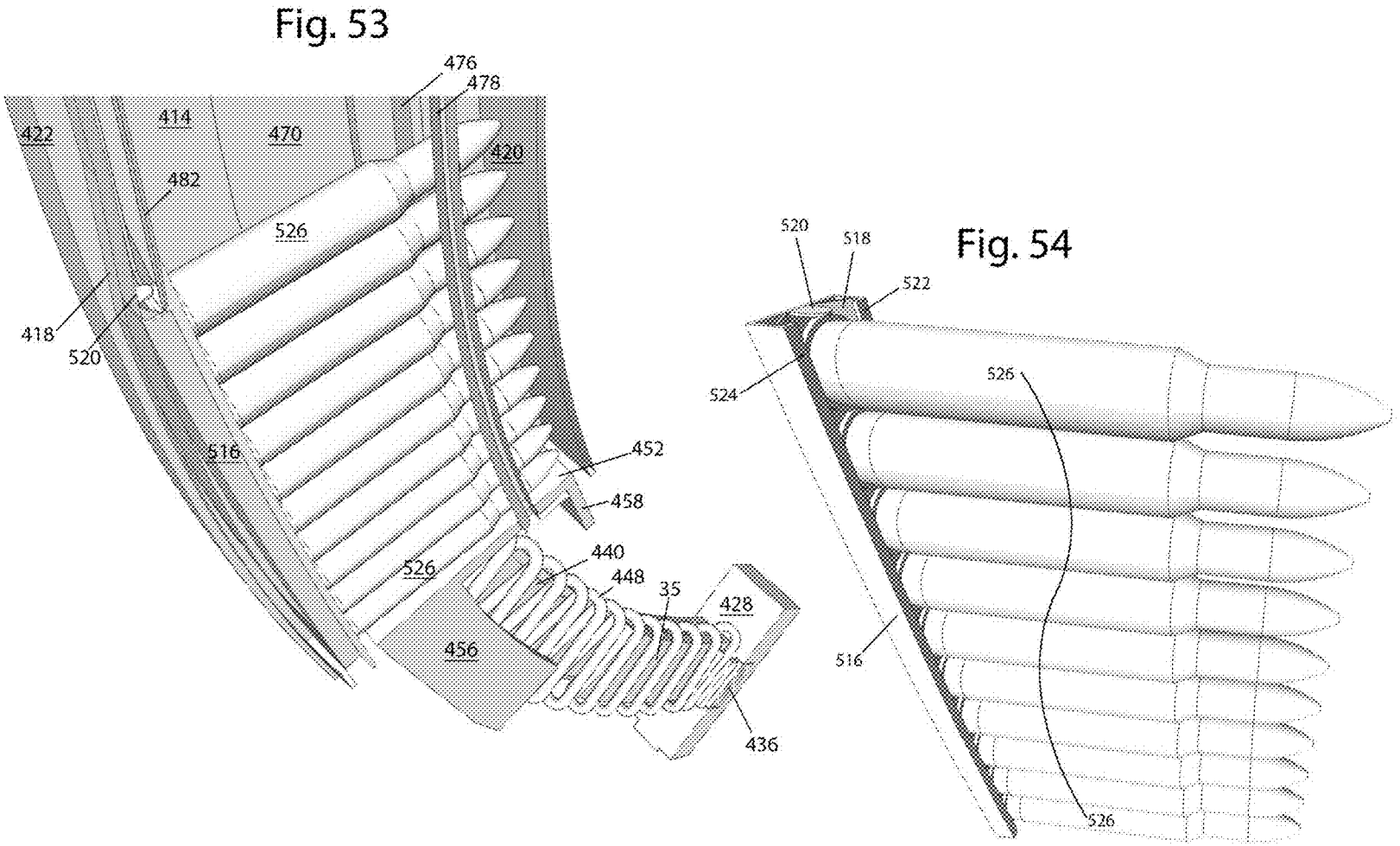
FIG. 53 depicts the stripper clip assembly installed in the open magazine chamber of the device of FIG. 41.
FIG. 54 illustrates the stripper clip assembly of FIG. 53.

FIG. 53 illustrates the open magazine, as a cut away, skewed plan view, illustrating the stripper clip assembly generally as 516 inserted into the magazine system chamber and the manner in which stripper clip 516 components 522 and 524 (shown in FIG. 54) match internal magazine components 482 and 484 (not shown), how stripper clip 516 rests against stripper clip stop rail 464 and 466, and the method of indexing provided by follower guide/shell case neck retainer tabs 476 and 478.

FIG. 54 illustrates a commercially available preloaded stripper clip containing ten rounds of ammunition generally noted as 516. Stripper clip 516, brass spring device 518, end tab 520, retainer rails 522 and 524, shell casings referred generally as 526.

Figures 55, 56A, 56B, 57A, 57B:
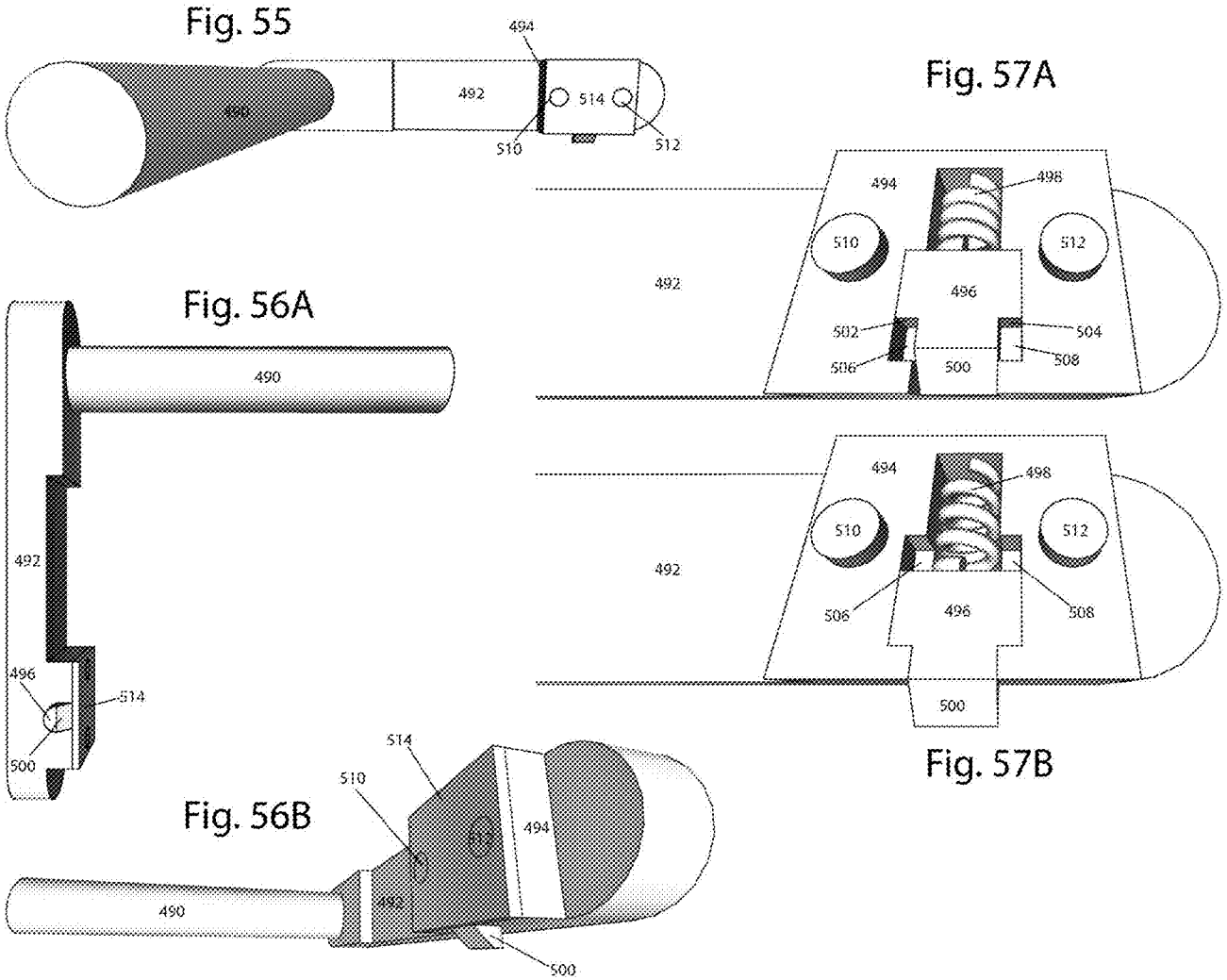
FIG. 55 is a view of the magazine locking device of FIG. 41.
FIGS. 56A and 56B are alternate views of the magazine locking device of FIG. 55.
FIGS. 57A and 57B provide cutaway perspectives of the internal components of the locking device of FIG. 55.

FIGS. 55, 56A, and 56B illustrate a locking device from multiple angles and includes a threaded rod 490, spanner arm 492, tab 494 lock detent 496 and cover plate 514.

FIGS. 57A and 57B illustrate the locking device inner components such as detent pin 496, tension spring 498, sloped face 500, interlocking tabs 502 and 504, corresponding tab receiver slots 506 and 508, compression studs 510 and 512, and cover plate 514.

Figure 60:
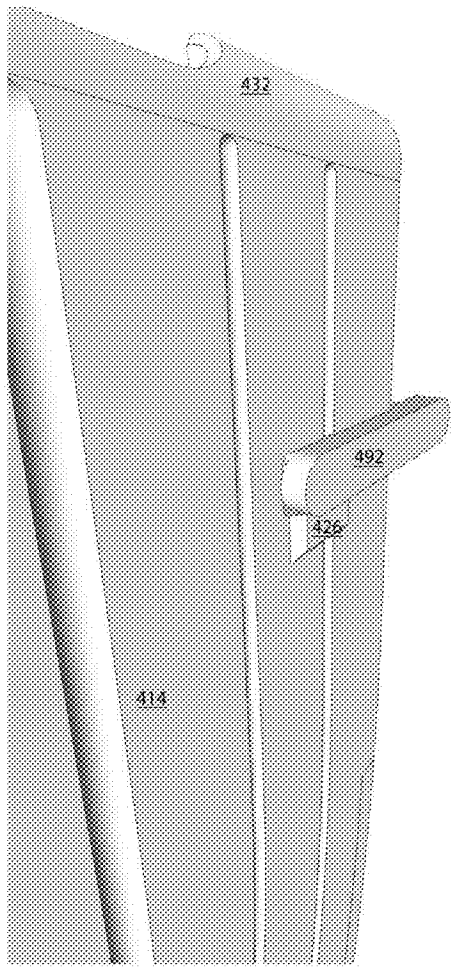
FIGS. 58, 59, and 60 illustrate the magazine wall components as they relate to the locking device of FIG. 55.
Figure 59:
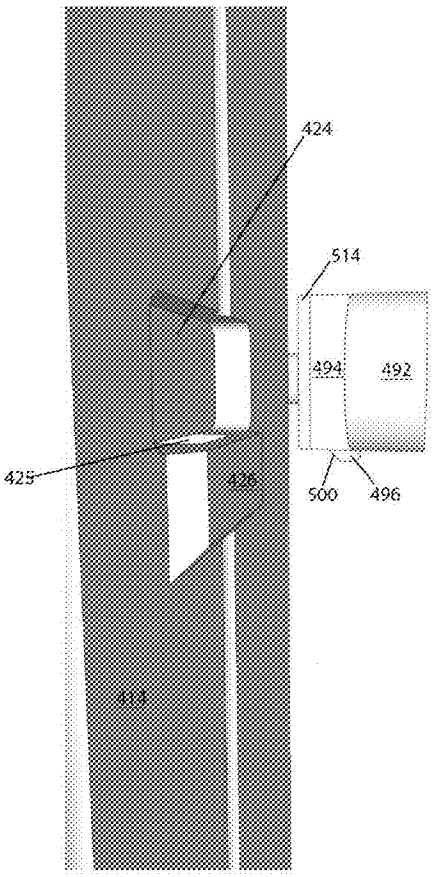
Figure 58:
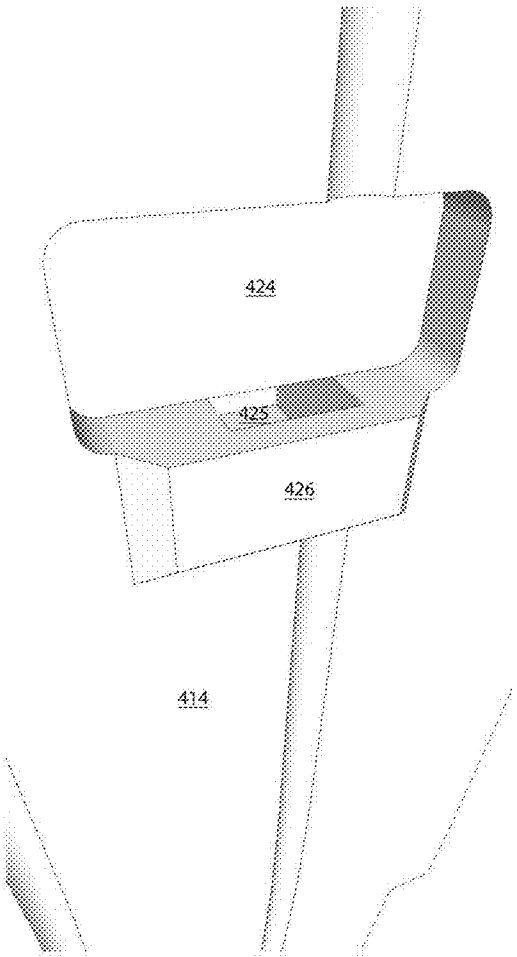

FIGS. 58, 59, and 60 illustrate the upper magazine index slot 424, stop tab 426, detent slot 425 as it relates to the locking device function, tab 494, detent pin 496, slope face 500 and spanner arm 492, securing the non-detachable/reloadable magazine system to the carbine type rifle.

Another embodiment of a device of the present disclosure is now described.

Figure 61:
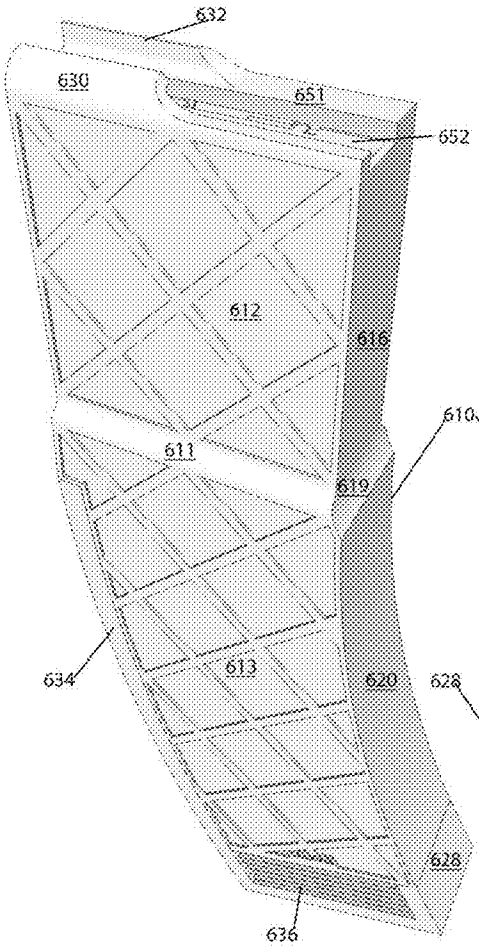
FIG. 61 is a side elevational view of the non-detachable, reloadable box magazine invention.
Figure 62:
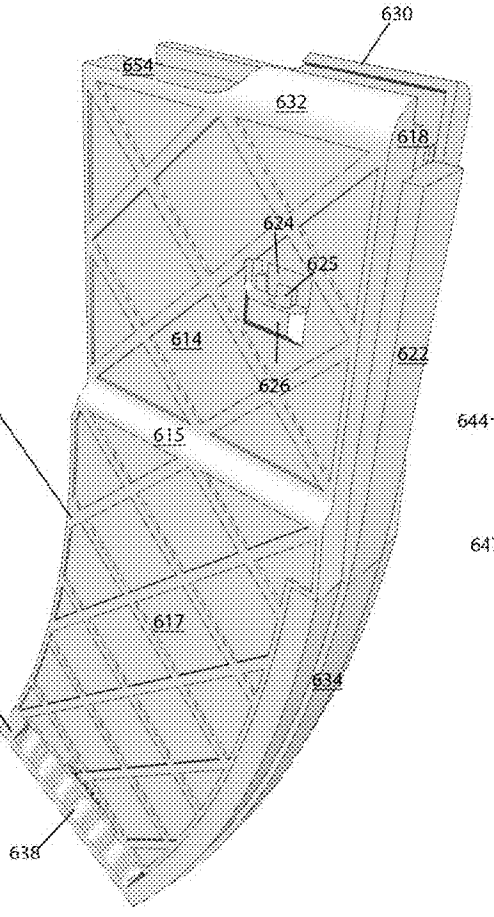
FIG. 62 is an opposing elevational side view of the non-detachable, reloadable box magazine system invention.
Figure 77:
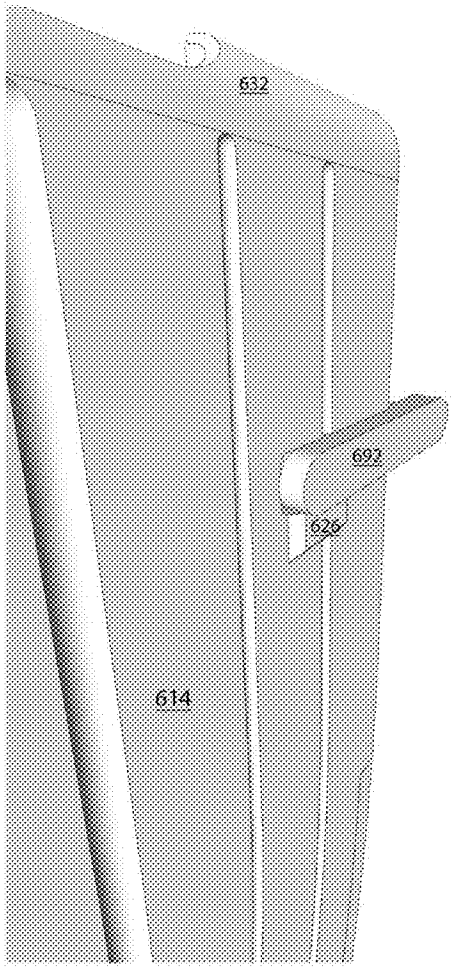
FIGS. 75, 76, and 77 illustrate magazine wall components of the device of FIG. 61 as they relate to a locking device.

FIGS. 61 and 62 illustrate opposing views of the magazine system in the closed configuration as a box magazine body indicated generally as 610 in having side walls 612 and 614, Expansion arches 611 and 615, expanded side walls 613 and 617 mutually opposing end walls 616 (with expansion arch 619 and lower expanded end wall 620) and 618, open top view with curved feed lips 630 and 632, a base plate 628, with upper magazine index slot 624, stop tab 626, and magazine index tab 622. The shape of the box magazine 610 is that of an arched box. The end wall 616 is expanded in the lower arched section by expansion arch 619 and lower expanded end wall 620, to allow clearance for the preloaded 10 round ammunition stripper clip (FIG. 77). Side walls 613 and 617 are expanded by expansion arch 611 and 615 to allow for the additional components required in the rear wall extension rails.

Figure 63:
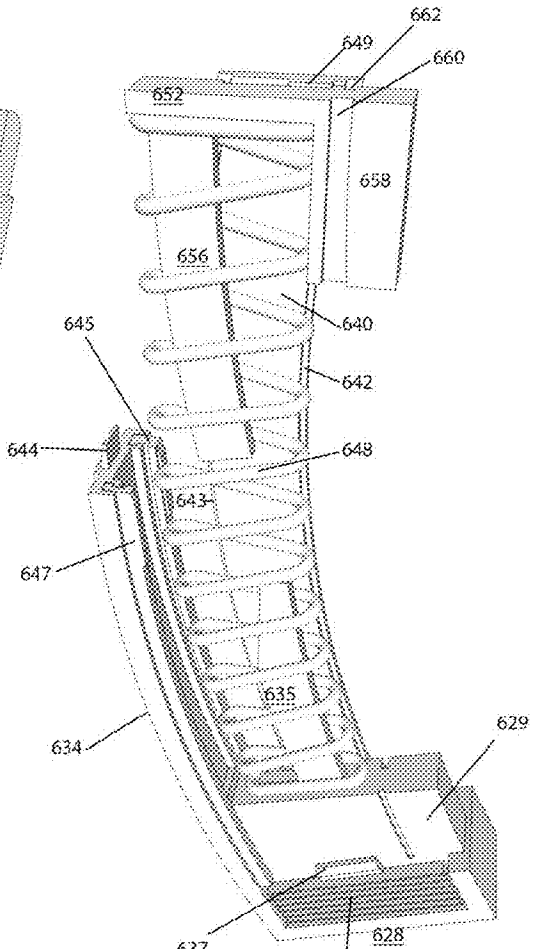
FIG. 63 is an elevational view of the internal components of the base assembly of the non-detachable, reloadable box magazine system invention.

FIG. 63 illustrates the internal components of the magazine system consisting of the base plate 628, squeeze tab 636, squeeze tab lock 637, support block 629, rear magazine wall cover 634, rear wall cover catch tab 644, rear wall extension rails 645 and 647, arched base plate guide 640, arched guide tabs 642 and 643, spring 648, follower, indicated generally as 652, (FIGS. 67 and 68), follower end guide 658, spring torque limiter 656, tapered tab receiver slots 660 and 662, capacity limiting block 635, and stop limiter tab 649.

Figure 64:
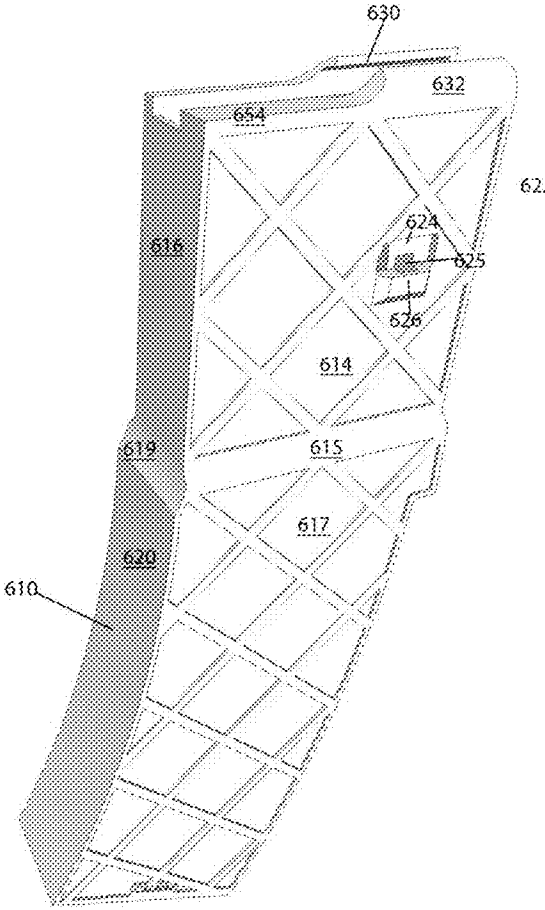
FIG. 64 is the elevational view of the magazine body only, without the internal components of FIG. 63.

FIG. 64 illustrates the magazine body 610 absent the internal system components of FIG. 63.

Figure 65:
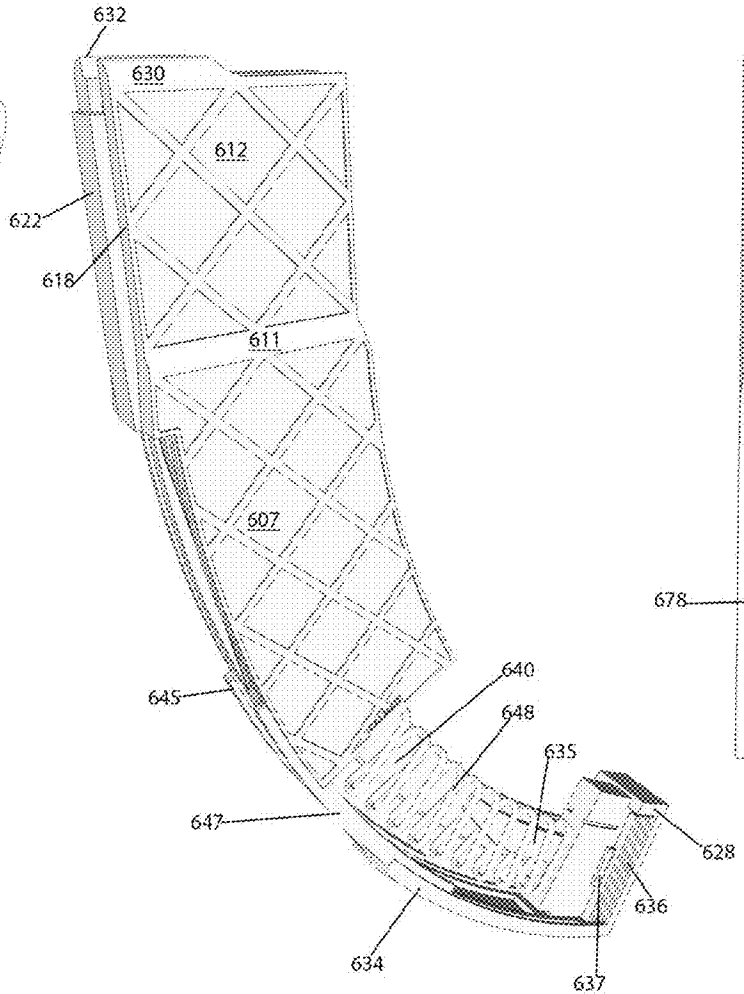
FIG. 65 is an elevational view of the non-detachable, reloadable magazine system in its fully open position.

FIG. 65 illustrates the system components (described in FIGS. 61, 62, and 63) together in the open configuration.

Figure 66:
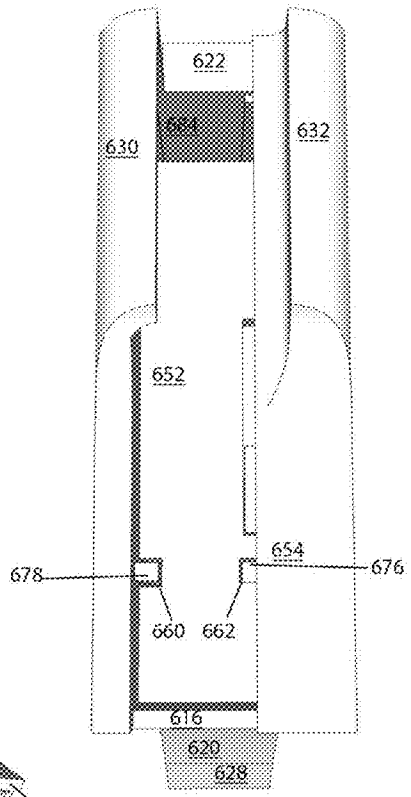
FIG. 66 is a top view of the magazine body showing the follower in its top most position.
Figures 67, 68, 69, 70:
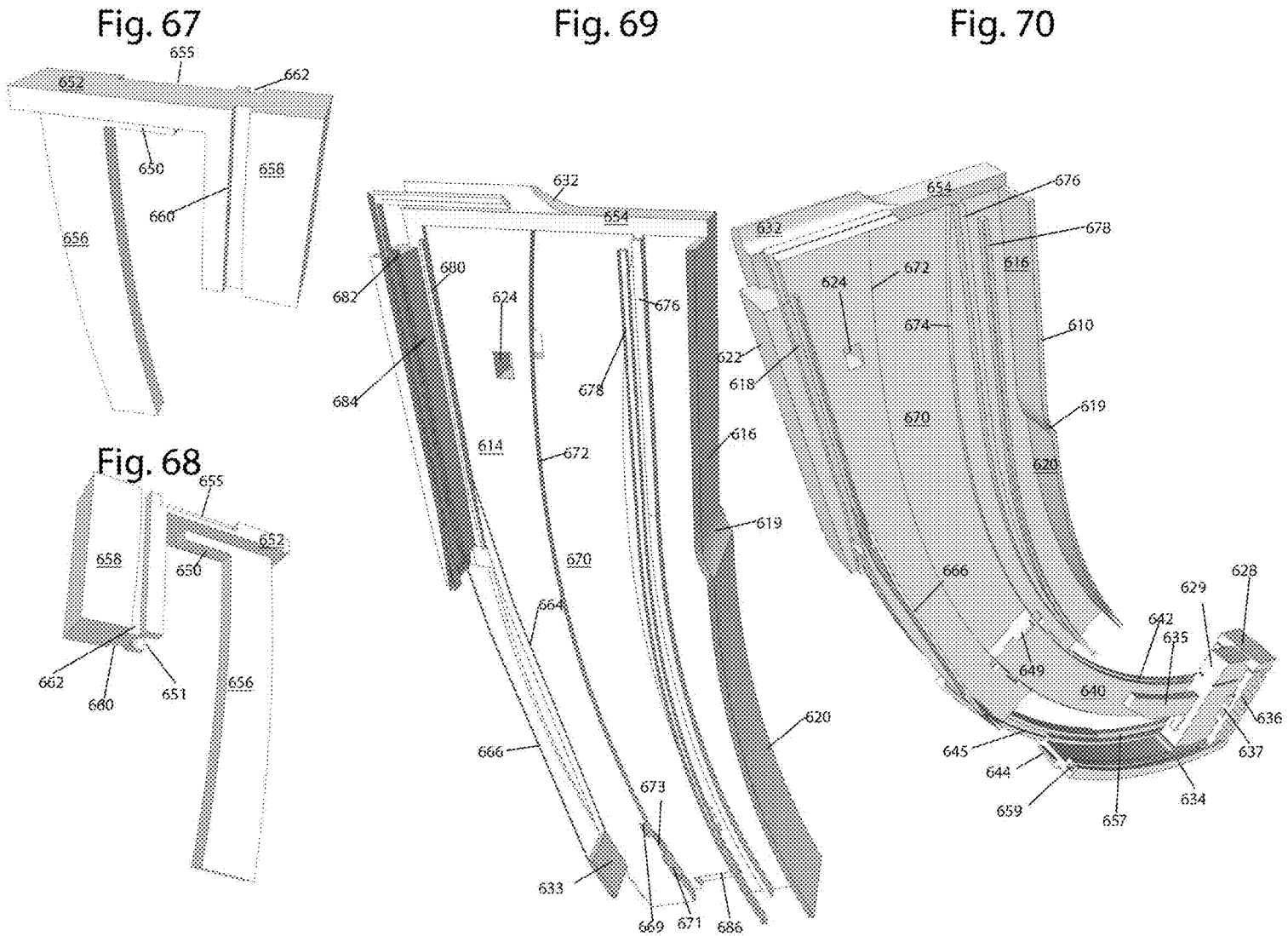
FIG. 67 is an elevational side view of the follower.
FIG. 68 is an opposing elevational side view of the follower.
FIG. 69 is the elevational cutaway view of the internal components of the box magazine.
FIG. 70 is an elevational cutaway view of the internal components showing the function of the base plate assembly in relation to the box magazine body.

FIG. 66 illustrates the top view of the magazine system with follower 652 in its top position, tab receiver slots 660 and 662, magazine feed lips 630 and 632, shell case index block 654, lower end wall 620, base 628, and magazine index tab 622. Additional illustrated components are the tops of some internal components (ref. FIGS. 69 and 70), follower guide/shell casing nose guide tabs 676 and 678 (ref. FIG. 70).

FIGS. 67 and 68 illustrate the follower generally as 652, end guide 658, spring torque limiter 656, shell casing nose and follower guide tapered slots 660 and 662, travel limiter slot 655, spring cutout 651 and spring retention tab 650. The follower is improved and specifically designed to the function of the non-detachable/reloadable magazine invention.

FIG. 69 illustrates the internal box magazine system components comprising: arched base plate receiver pocket 670, assembly keys slots 669 and 671, retainer tab track 672, squeeze tab receiver lock detent 686, follower guide/shell case neck retainer rails 676 and 678, shell casing base guide slot 684, shell casing base index tabs 680 and 682, magazine body 610 interior side wall 614, upper magazine index slot 624, end wall 616, end wall expansion arch 619, lower expanded end wall 620, shell case index block 654, arched guide stop 673, back wall block 633, stripper clip stop rails 664 and 666, and feed lip 632.

FIG. 70 illustrates (in a semi open position) the interaction of internal box magazine 610 system components with the base assembly 628 components rendering specifically the mating of arched base plate guide 640 with arched base plate receiver pocket 670 and the corresponding tab interaction between arched guide tabs 642 and 643, retainer tab track 672 and 674 respectively, Stripper clip stop rail 666, shell case index block 654, upper magazine index slot 624, rear wall cover plate 634, rear wall extension rail 645, corresponding rear wall extension rail guide slots 657 and 659, rear wall cover catch tab 644, capacity limiting block 635, base plate 628, support block 629, squeeze tab 636, and squeeze tab lock 637. FIG. 70 further illustrates an opposing view of internal components cataloged in FIG. 69.

Figure 71A:
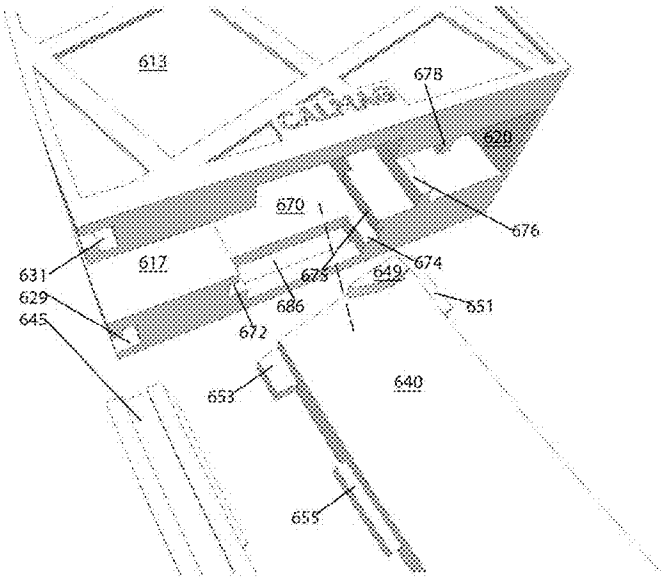
FIGS. 71A and 71B are views of the open bottom of the magazine body.
Figure 71B:
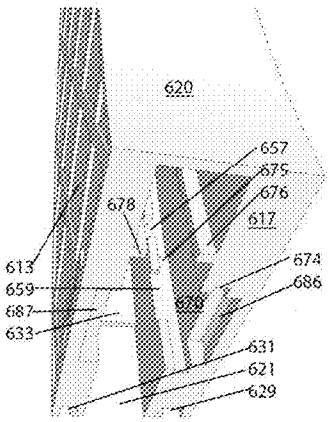

FIGS. 71A and 71B illustrate an open bottom view of the internal components of magazine walls 613, 617, and 620 with an illustration of the top of base plate arched guide 640 and the stop tabs 651 and 653. Stop tabs 651 and 653 prevent the arched base plate guide from exiting from arched base plate receiver pocket 670, prevented from doing so by the corresponding arch guide stop tabs 673 and 675 located at the base of arched base plate receiver pocket 670 below the assembly key slots 669 and 671 (FIG. 69). These stop tabs are a reduction in the slot size of retainer tab tracks 672 and 674 and created the necessity for the addition of the assembly key slots 669 and 671. An additional component of base plate arched guide 640 is the travel limiter tab 649 which retains follower 652 and spring 648 (not shown) relative to arched base plate guide 640 when the system is pulled in the open configuration. Without this travel limiter tab 649, follower 652 and spring 648 would naturally revert to the springs fully extended point. This would conflict and hamper the insertion of the stripper clip. The figures further detail the back wall block 633, the base of follower guide/shell case retainer rails 676 and 678 and squeeze tab receiver lock detent 686 unseen when the magazine system is assembled.

Figure 72:
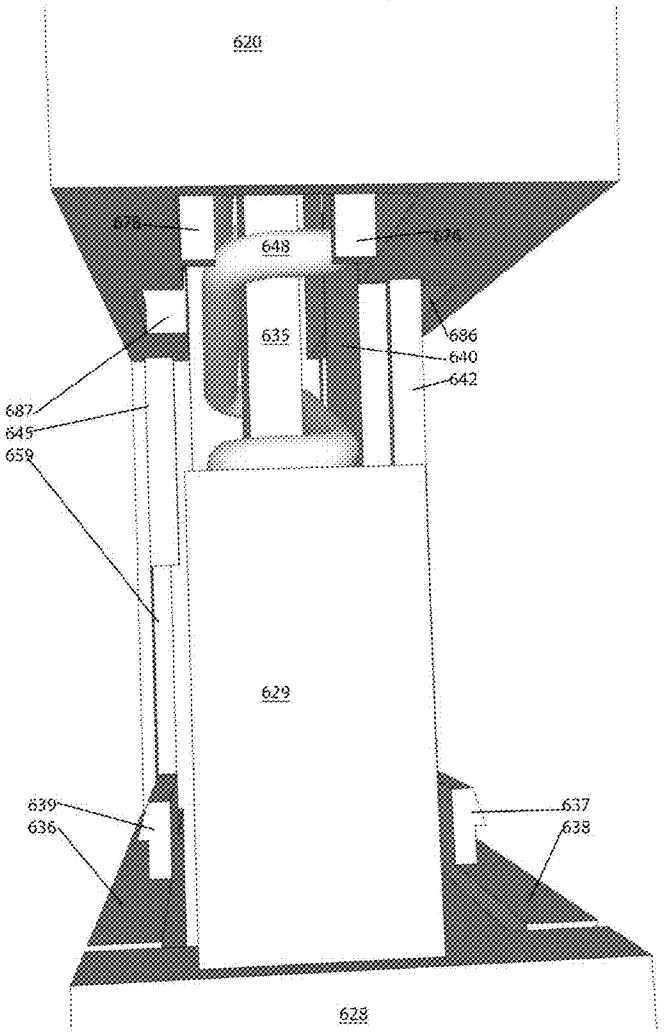
FIG. 72 is a detail view of the base plate components.

FIG. 72 illustrates the components of base plate assembly 628 and how they relate to corresponding components inside open bottom 621 (FIG. 71). Specifically squeeze tabs 636 and 638 with tab locks 637 and 639 and their matching squeeze tab receiver detents 687 and 686 (referred to above with respect to FIG. 71). Further illustrations detail spring 648, support block 629, follower guide/shell casing neck retainer rails 676 and 678, and capacity limiting block 635 and how it provides center support to spring 648. Further illustration includes an end view of rear wall extension rail 645 and its corresponding rear magazine extension rail guide slot 659 as an integral part of back wall 634 (FIGS. 70 and 73).

Figure 73:
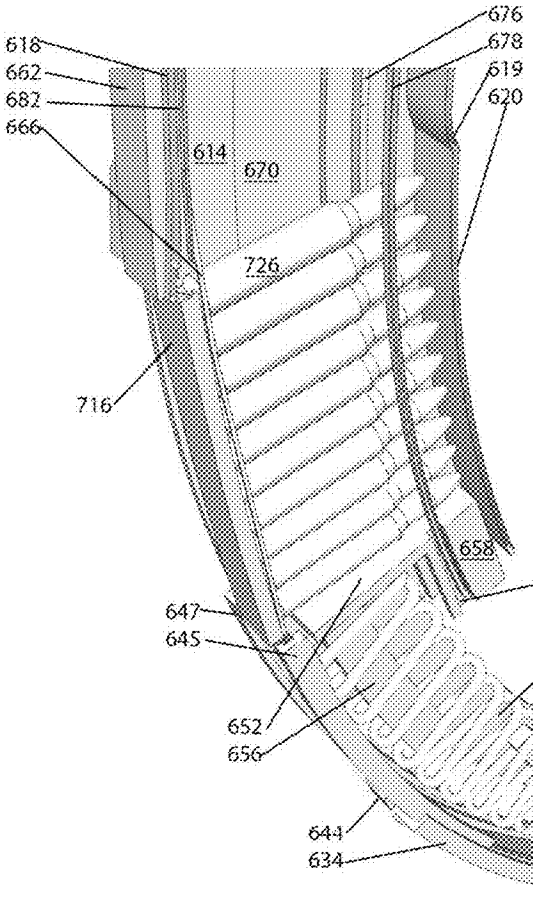
FIG. 73 represents the stripper clip assembly installed in the open magazine chamber.

FIG. 73 illustrates the open magazine, as a cut away, skewed plan view, illustrating the stripper clip assembly 716 inserted into the magazine system chamber and the manner in which the rear wall extension rail 645 and 647 provide additional indexing for stripper clip assembly 716. Stripper clip stop tabs 664 (not seen) and 666, FIG. 73 further illustrates the manner in which the follower 652 engages the stripper clip, how the spring torque limiter 656 interacts with the spring in the open position, how tapered guide slot 660 interacts with follower guide/shell case neck retainer rail 678 and is a further illustration of the base plate assembly components (FIGS. 63, 65, 70, and 72).

Figure 74:
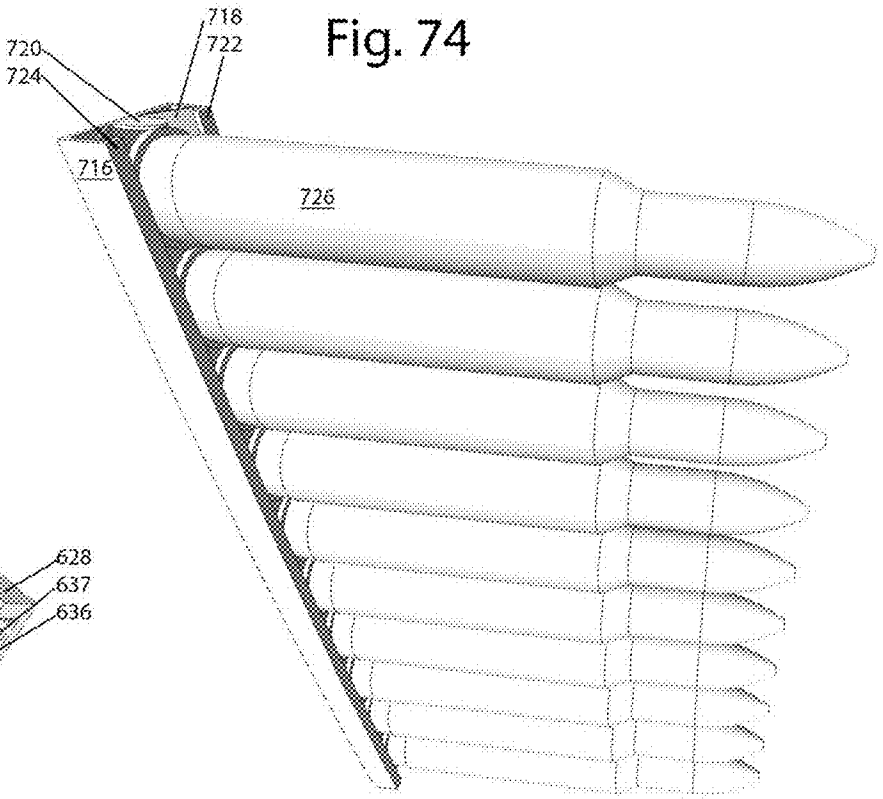
FIG. 74 illustrates the stripper clip assembly.

FIG. 74 illustrates a commercially available preloaded stripper clip 716 containing ten rounds of ammunition. Stripper clip 716, brass spring device 718, end tab 720, retainer rails 722 and 724, shell casings referred generally as 726.

Figure 76:
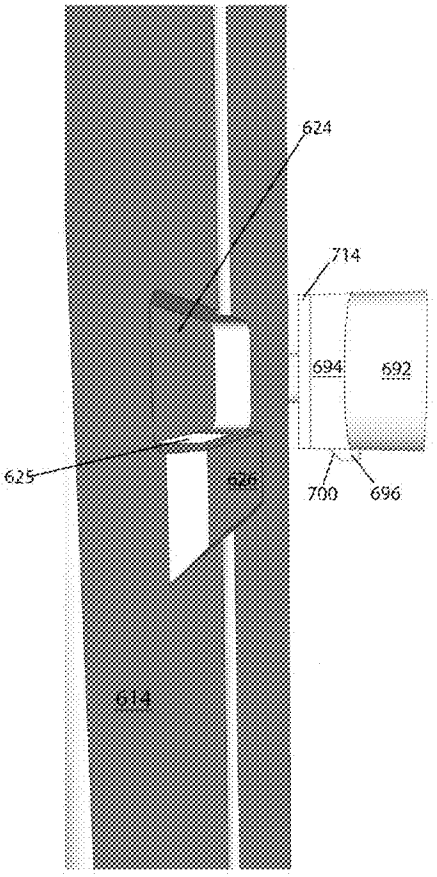
Figure 75:
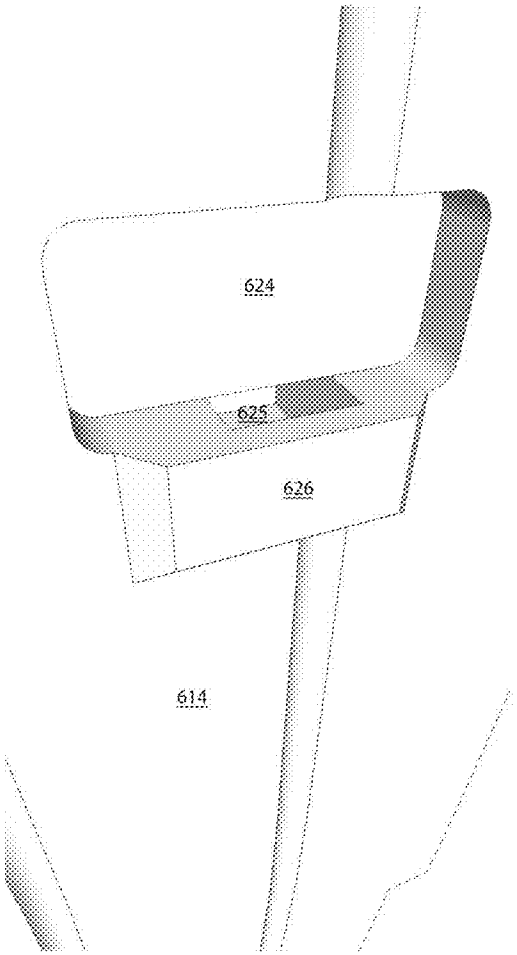

FIGS. 75, 76, and 77 illustrate the upper magazine index slot 624, stop tab 626, detent slot 625 as it relates to the locking device function, tab 694, detent pin 696, slope face 700 and spanner arm 692, securing the non-detachable/reloadable magazine system to the carbine type rifle.

As the magazine is inserted into the rifle's magazine well, stop tab 626 forces detent pin 696 up into tab 694. The locking device 692 then slams into upper magazine slot 624 and detent pin 696 drops into detent slot 625 effectively locking the non-detachable reloadable magazine system securely to the carbine type rifle. Once installed on the rifle using additional commercially available spring and push button nut it prevents the removal of this non-detachable reloadable magazine invention.

Figures 78, 79, 80, 81, 82:
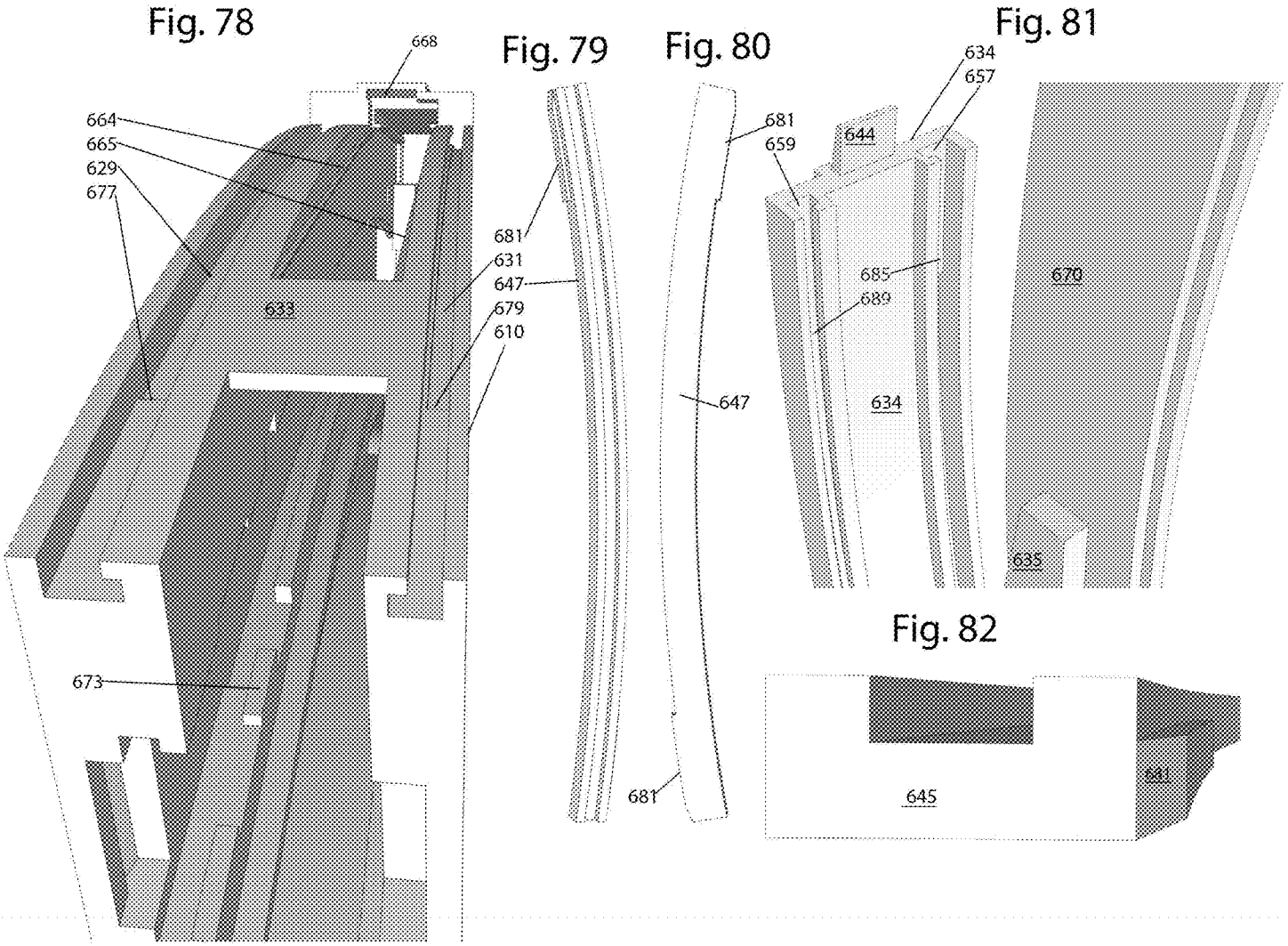
FIGS. 78, 79, 80, 81, and 82 illustrate the rear wall extension rails, their counter parts, and how they interact.

FIGS. 78, 79, 80, and 81 illustrate the components involved in the rear wall extension rails. FIG. 78 is the open bottom end view of the magazine body indicated generally as 610. FIGS. 79 and 80 depicts the rear wall extension rail(s) 645 and 647, 647 is a mirror image of 645. FIG. 81 is of the rear magazine wall cover 634 which is integrated into the base 628. FIG. 82 is an end view of the rear wall extension rail.

Rear wall extension rails 645 and 647 are inserted into the rear magazine extension rail guide slots 629 and 631 respectively. Once inserted the extension rail stop tabs 681 located at each end of the rear magazine extension rail are prevented from removal by extension rail stop tabs 677 and 679 located in the base of rear magazine extension rail guide slots 629 and 631. The rear wall extension rails 645 and 647 are then inserted into the rear wall extension rail guide slots 657 and 659 respectively. The extension rail stop tabs 681 then interact with the extension rail stop tabs 685 and 689 locate at the top end of rear wall extension rail guide slots 657 and 659 respectively. Once assembled the components provide additional strength to the magazine operation when in the open position for loading. Further indexing is achieved for the insertion of a stripper clip assembly 716. This assembly adds additional restriction to the errant movement of the spring 648 and the follower assembly 652 during the reloading process. Back wall block 633 adds rigidity to the entire assembly during the reloading process.

General operation of the various embodiments of the present disclosure is now provided in detail.

The base plate and squeeze tabs of the device are depressed until the squeeze tab lock is freed from the squeeze tab receiver lock detents. The grip tab and squeeze tab are used to draw the base plate downward. The base plate arched guide, which is retained in the base plate arched receiver pocket by correlated indexing between the arch guide tabs, and the retainer tab tracks keep the system components aligned.

The base plate arched guide and corresponding base plate arched receiver pocket preferably run the entire length of the magazine body interior wall. This indexing allows the base to move up and down in a smooth sweep motion. The following components are preferably permanently affixed to the base plate: the squeeze tabs, including the lock tab, the grip tab, the base plate arched guide, the side magazine wall cover, the side wall cover guide rail, the spring retention tab, and the capacity limiting block. While these are preferably permanently affixed, it is contemplated that any or all of these components may be removably attached to the base plate. The base plate assembly is preferably affixed to the spring by the spring retention tab, which in turn retains the follower assembly at the other end of the spring by another spring retention tab. The travel limiter tab interlocks with the follower in the travel limiter slot and together retains all components at a desired overall length while keeping all internal components of the system together as one movable unit.

As the downward pull of the base plate continues, the travel limiter tab pulls the spring and follower down with it. The follower is held in index in a number of ways. The follower tab receiver slots rise along the follower guide/shell case nose guide rails. In addition, the follower end guides and the spring torque limiter ride along the inside walls of the box magazine, keeping the follower horizontally indexed. As the base plate completes its downward motion, the follower stop tabs at the base of the magazine body, in conjunction with the arched guide stop tabs at the top of the base plate arched guide, prevent the base plate assembly from existing out of the open bottom when fully open. The follower guide/shell case neck retainer rails preferably run the full inside length of the magazine walls, from top to bottom, while following the general curve of the magazine shape, and are oriented to corresponding with the shell casing neck, just forward of the shell casing bevel. The rails provide secondary support of the shell case by preventing side to side horizontal movement of the case neck. The rails also provide a guide track for the follower through the interaction of the rails and the tab receive slots located on the follower.

An ammunition stripper clip assembly can now be loaded into the weapon, as described into greater detail below. The user then reverses the process described above.

Upward force applied to the bottom of the base assembly, which is guided by the correlation with the base plate arched guide, retained in the base plate arched receiver pocket, causes the follower to contact the shell casing of the first (bottom) round of ammunition. This compresses the spring and follower until the bottom of the follower contacts the top of the capacity limiting block. During this phase of compression, the spring is held from deformation by the capacity-limiting block, spring torque limiter, and base plate arched guide.

As additional force is applied to the base plate assembly, the tab on the top of the stripper clip assembly bends upwards into the shell casing base guide slot, allowing the continuously-applied force to push rounds up and away from the stripper clip assembly and into the shell casing base guide slot. The bases of the rounds are held in index by the shell casing base index tabs as they pass up and into the shell casing base guide slot. The rounds are held in index by an additional combination of interior components, which include the follower guide/shell case neck retainer rails and the box magazine side wall, until the top round of ammunition contacts the box magazine feed lip and is retained in the proper orientation by the shell case index block. Further upward force now compresses the follower and spring until the base plate squeeze tab lock re-engages with the box magazine squeeze tab receiver lock detent, and the side wall cover guide rail engages the side wall index tab, completing the cycle securely closing the magazine system.

Further details of the loading process are now described.

A preferred embodiment of the non-detachable/reloadable magazine device of the present disclosure relies on a commercially-availabile preloaded stripper clip containing ten rounds of ammunition. This eliminates the burden of loose rounds (or shell casings). Once the stripper clip assembly is inserted, force applied by the compression of the follower, the spring, and the capacity limiting block, mates the base of the stripper clip assembly with the internal components of the box magazine. The shell casing base guide slot and the shell casing base index tabs are designed to marry in a transfer between the base of the stripper clip and the shell casing guide slot. The stripper clip shell casing retainer rails correspond to the shell casing base index tabs. These components lock the shell casings from twisting, sliding, or elevating out of the established index created by the stripper clip design. The internal magazine components provide the necessary transitional channel allowing the shell casing to be forced up without losing continuity or becoming loose within the magazine chamber. The base support system, in conjunction with the follower guide/shell casing neck retainer rails, further prevent induced malfunction of the loading transfer process of the preloaded stripper clip assembly. The box magazine shell case index block, and curved feed lip, prevent the first, or top, round of ammunition from miss aligning thereby completing the process.

In preferred embodiments of the present disclosure, the magazine box is about 7½ inches long and about ⅞ of an inch wide, with a width of about 2⅝ inches, an interior length of 7½ inches, width of 2⅜ inches, and depth of about ¾ of an inch. Also in such preferred embodiments, the top portion of the magazine body is straight for about 2.5 inches then arched in the lower 5 inches or so at a radius of about 11 inches with an angle of about 21 degree angle. It is contemplated, however, that any suitable dimensions may be employed with respect to the device of the present disclosure, or any of its parts, and that the dimensions provided above are not limiting.

It is to be understood that the various embodiments described herein are exemplary, and that modifications to what is disclosed herein may be readily apparent to those of skill in the art upon reading this disclosure. Such modifications are contemplated to be within the spirit and scope of the present disclosure.

Having thus described the preferred embodiment of the device, what is claimed as new and desired to be protected by Letters Patent includes the following:

1. In a rifle having a lower receiver defining a magazine chamber, the improvement comprising:

a magazine body attached to said rifle, wherein the magazine body comprises a front end wall, a rear end wall, and a rear cover plate;

a base plate attached to said rear cover plate, wherein the base plate releasably and slidingly engages said magazine body and forms a base thereof; and a release attached to one of said base plate, said rear cover plate, or said magazine body and configured to releasably secure said base plate to said magazine body, wherein when said base plate is secured to said magazine body the base plate is released from said magazine body by actuation of said release by a user thereof;

wherein said base plate is configured to move in sliding engagement away from said magazine body when released, thereby causing a corresponding movement of said rear cover plate and exposing an inner chamber of said magazine body for insertion of an ammunition stripper clip therein.

2. The device according to claim 1, further comprising a locking member removably attached to said magazine body, the locking member comprising:

a threaded rod configured for insertion through an opening defined in the lower receiver of said rifle;

an arm extending from said threaded rod at about a ninety degree angle therefrom; and a detent member extending downwardly from said arm, wherein said detent member is configured to be received into a slot defined in said magazine body, and further wherein when said detent member is received into said slot said magazine body is securely affixed to said rifle.

3. The device according to claim 2, wherein the opening through which said threaded rod is configured to be inserted is sized and shaped to receive a conventional magazine release assembly.

4. The device according to claim 1, wherein the release is attached to one of said base plate or said rear cover plate and the release comprises a tab extending from said base plate or said rear cover plate, said tab configured to be received into a slot defined in said magazine body, wherein when said tab is received in said magazine body said base plate is secured in a closed position with respect to said magazine body, and further wherein when said tab is disengaged from said slot, said base plate is slidable away from said magazine body.

5. The device according to claim 4, further comprising:

an arched guide extending upwardly from said base plate;

an arched receiver pocket defined in said magazine body and configured to slidingly receive said arched guide;

a first stop tab extending from said arched receiver pocket; and a second stop tab extending from said arched guide, wherein when said base plate is moved slidingly in a downward direction, away from said magazine body, contact between said first stop tab and said second stop tab prevents said base plate from being detached from said magazine body.

* * * * *